US008210519B2

(12) United States Patent
Fukusaka et al.

(10) Patent No.: US 8,210,519 B2
(45) Date of Patent: Jul. 3, 2012

(54) SHEET FEEDING APPARATUS AND IMAGE FORMING APPARATUS

(75) Inventors: Tetsuro Fukusaka, Abiko (JP); Yuzo Matsumoto, Abiko (JP); Yoshitaka Yamazaki, Abiko (JP); Tomoharu Sato, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/102,219

(22) Filed: May 6, 2011

(65) Prior Publication Data

US 2011/0278787 A1 Nov. 17, 2011

(30) Foreign Application Priority Data

May 17, 2010 (JP) ..... 2010-113291

(51) Int. Cl.
*B65H 3/14* (2006.01)
*B65H 3/34* (2006.01)
*B65H 3/46* (2006.01)

(52) U.S. Cl. ..... 271/98; 271/104; 271/105

(58) Field of Classification Search ..... 271/97, 271/98, 104, 105
See application file for complete search history.

(56) References Cited

U.S. PATENT DOCUMENTS

| | | | | |
|---|---|---|---|---|
| 7,540,489 | B2 | 6/2009 | Kushida | |
| 7,591,459 | B2 | 9/2009 | Matsumoto et al. | |
| 2001/0017441 | A1 * | 8/2001 | Yamaguchi et al. | 271/94 |
| 2002/0145246 | A1 * | 10/2002 | Goda et al. | 271/98 |
| 2008/0088078 | A1 | 4/2008 | Kushida | |
| 2011/0169211 | A1 | 7/2011 | Matsumoto et al. | |

* cited by examiner

*Primary Examiner* — David H Bollinger
(74) *Attorney, Agent, or Firm* — Fitzpatrick, Cella, Harper & Scinto

(57) ABSTRACT

An upper air blowing portion that blows air from above a sheet held by a tray is provided above the portion between a trailing end restricting plate and an absorption conveyance portion. A controlling portion drives the upper air blowing portion so as to restrict the movement of the sheet in the direction reverse to the sheet feeding direction, when the sheet held on the tray moves in the direction reverse to the sheet feeding direction with the air blown by the air blowing portion.

18 Claims, 22 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly to the sheet feeding apparatus that separates and feeds a sheet by blowing air to a sheet.

2. Description of the Related Art

Conventionally, an image forming apparatus such as a printer, or a copying machine, includes a sheet feeding apparatus that feeds a sheet one by one from a sheet storing portion storing plural sheets. As the sheet feeding apparatus as described above, there is an air feeding system in which air is blown to the end of a sheet bundle stacked onto a tray in a sheet storing portion so as to blow up plural sheets, and only one sheet is absorbed to an absorption conveyance belt arranged above the sheet storing portion.

The sheet feeding apparatus includes a trailing end restricting member that restricts the trailing end of the sheet bundle stacked onto the tray, and a trailing end pressing member that is provided to the trailing end restricting member to be capable of moving in the vertical direction. The trailing end pressing member presses the trailing end of the sheet, which is blown up by the blown air with the position of the trailing end being restricted by the trailing end restricting member, with a fixed force from above. The position of the top surface of the uppermost sheet is detected based on the position of the trailing end pressing member in the vertical direction, whereby the lifting and lowering of the tray is controlled in order that the distance between the top surface of the uppermost sheet and the absorption surface of the absorption conveyance belt falls within a fixed range.

Since the trailing end pressing member is provided, the trailing end of the sheet is pressed by the trailing end pressing member, even when the uppermost sheet is blown up by the air blown from a leading end separation duct located at the side of the leading end of the sheet. As a result, only the central part of the uppermost sheet in the width direction is separated from the second sheet, and when the separated uppermost sheet is absorbed by the negative pressure of the absorption conveyance belt, a gap is formed between the uppermost sheet and the second sheet with the closed trailing end.

Since the gap described above is formed, air flowing through the gap flows all over the portion between the uppermost sheet and the second sheet. Consequently, the uppermost sheet and the second sheet can effectively be separated from the leading end of the sheet to the trailing end thereof, whereby the separation property of the sheet is enhanced. This technique is described in U.S. Pat. No. 7,540,489.

In the conventional sheet feeding apparatus, the trailing end of the sheet is restricted by the trailing end restricting plate, and pressed by the trailing end pressing member from above, so that, when loosening air is blown from the leading end of the sheet, the sheet is pushed toward the downstream side in the blowing direction. When a sheet having a small rigidity (degree of rigidity), e.g., a sheet called a thin sheet having a basis weight of 50 g/m$^2$ or less, is fed, the sheet blown up by the loosening air blown from the leading end is pushed backward by the loosening air to be shifted backward. This is caused because of the reason described below. Specifically, since the rigidity of the sheet is small, the central part rises when the leading end of the sheet is pushed by the air with the trailing end being restricted. This condition is illustrated in FIG. 22. A sheet S stacked on a tray 12 is restricted by a trailing end pressing member 17 provided to a trailing end restricting portion 13. When loosening air and separation air are blown to the leading end of the sheet stacked onto the tray 12 from an air blowing portion 152 from a direction C or direction D, the central part of the uppermost sheet, which is blown up, might rise, in case where the rigidity of the sheet is small.

When the shift amount of the sheet Sb, which is the following sheet of the blowing-up uppermost sheet Sa, to the back of the uppermost sheet Sa is small, the leading end of the following sheet Sb might be exposed to the absorption conveyance belt 21. When the absorption conveyance belt 21 performs an absorption conveyance with this state, the absorption conveyance belt might absorb and convey the following sheet Sb together with the uppermost sheet Sa, which might cause a double feed. When the double feed described above is caused, a defective feeding such as skew feeding, or corner bending, might be generated. A defective image is generated, when a sheet is fed to an image forming portion with the double-feed state.

SUMMARY OF THE INVENTION

The present invention is accomplished in view of the current situation described above, and aims to provide a sheet feeding apparatus and an image forming apparatus that can surely separate even a thin sheet, and can absorb and convey the same.

A sheet feeding apparatus according to the present invention, includes a tray that supports a sheet and that can lift and lower, an air blowing portion configured to blow air toward the upstream in a sheet feeding direction from a downward end of the sheet held by the tray in the sheet feeding direction to blow up the sheet, an absorption conveyance portion configured to absorb and convey the uppermost sheet which is blown up by the air blown by the air blowing portion, a trailing end restricting portion configured to restrict the position of a trailing end of the sheet in the sheet feeding direction, and a pressure mechanism configured to apply pressure downward on the top surface of the uppermost sheet of the sheets held by the tray in order to restrict the movement of the sheet held by the tray in the direction reverse to the sheet feeding direction with the air blown by the air blowing portion, and a controlling portion configured to control the operation of the pressure mechanism.

Further features of the present invention will become apparent from the following description of exemplary embodiments with reference to the attached drawings.

DESCRIPTION OF THE EMBODIMENTS

Figure 1:
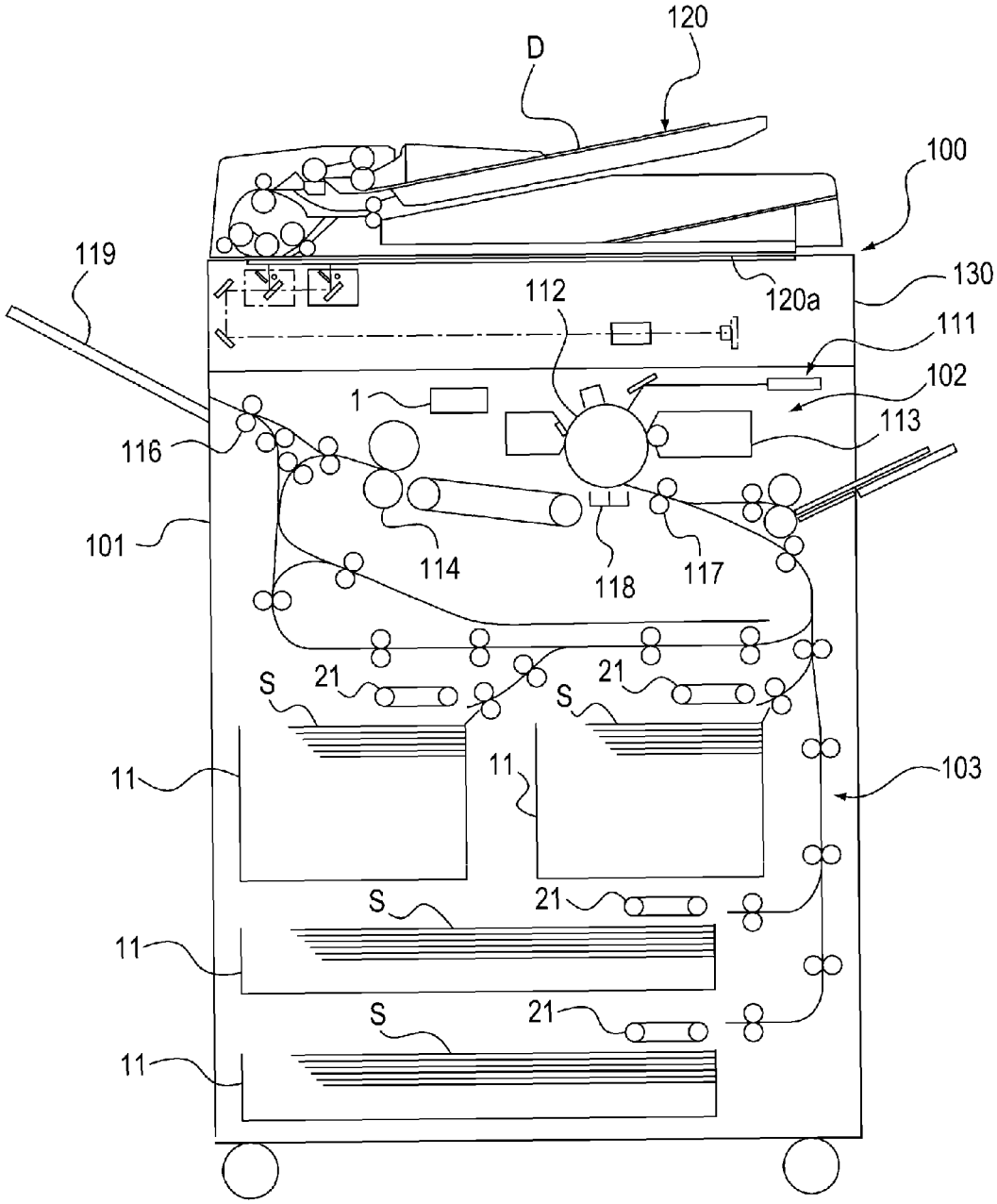
FIG. 1 is a schematic diagram illustrating a configuration of one example of an image forming apparatus provided with a sheet feeding apparatus according to a first exemplary embodiment of the present invention.

In the following, embodiments of the present invention will be described in detail with reference to the drawings. FIG. 1 is a schematic diagram illustrating a configuration of a printer, which is one example of an image forming apparatus provided with a sheet feeding apparatus according to a first exemplary embodiment of the present invention.

In FIG. 1, a printer 100 has an apparatus body 101. An image reading portion 130 that reads a document D placed onto a platen glass 120*a*, serving as an original placing platen, by an automatic document feeder 120 is provided on the apparatus body 101. An image forming portion 102 and a sheet feeding apparatus 103 which feeds a sheet S to the image forming portion 102, are provided below the image reading portion 130.

The image forming portion 102 includes a photosensitive drum 112, a development device 113, a laser scanner unit 111, and the like. The sheet feeding apparatus 103 includes plural sheet storage cases 11 that are detachable to the apparatus body 101 for storing a sheet S, and an absorption conveyance belt 21 that feeds the sheet S stored in the sheet storage cases 11.

An image forming operation of the printer 100 thus configured will next be described. When an image reading signal is output from a later-described CPU (controlling portion) 1 provided to the apparatus body 101 to the image reading portion 130, an image is read by the image reading portion 130. Thereafter, a laser beam corresponding to the electric signal is irradiated to the photosensitive drum 112 from the laser scanner unit 111. In this case, the photosensitive drum 112 is charged beforehand, whereby an electrostatic latent image is formed by the irradiation of light. The electrostatic latent image is then developed by the development device 113 so as to form a toner image onto the photosensitive drum.

On the other hand, when a sheet feeding signal for instructing the feed of the sheet is output from the CPU 1 to the sheet feeding apparatus 103, the sheet S is fed from the sheet storage case 11. Then, the fed sheet S is conveyed by a registration roller 117 to a transfer portion including the photosensitive drum 112 and a transfer charger 118, in synchronism with the toner image on the photosensitive drum. Thereafter, the sheet conveyed to the transfer portion has the toner image transferred thereon, and then, is conveyed to a fixing portion 114. Then, a non-fixed transfer image is permanently fixed on the sheet S by the application of heat and pressure by the fixing portion 114. The sheet having the image fixed thereon is discharged from the apparatus body 101 by a discharge roller 116 onto a discharge tray 119.

Figure 2:
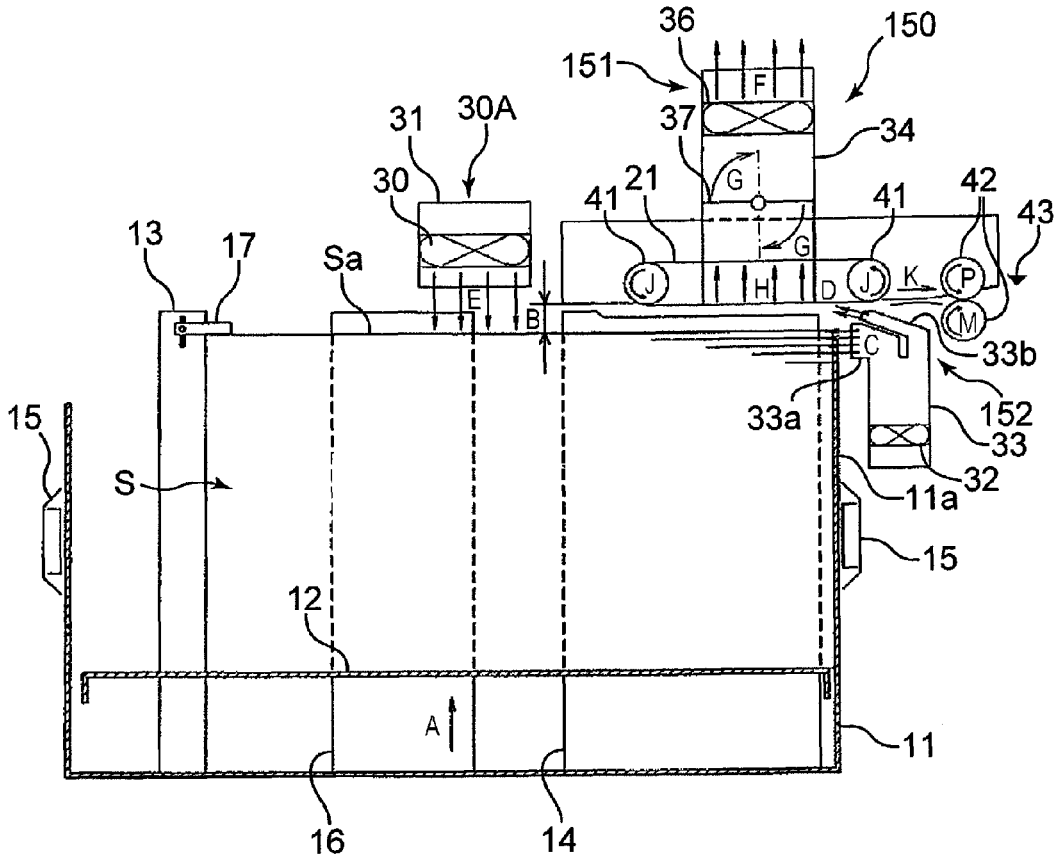
FIG. 2 is a sectional view illustrating the configuration of the sheet feeding apparatus according to the first exemplary embodiment.

FIG. 2 is a view illustrating a configuration of the sheet feeding apparatus 103. The sheet storage case 11 includes a tray 12 that can lift and lower and that has plural sheets S placed thereon, and a trailing end restricting plate 13 that serves as a trailing end restricting member for restricting a position of a trailing end through the contact to the trailing end of the sheet, the end of which is the upstream end of the sheet in the sheet feeding direction. The sheet storage case 11 also includes a leading end restricting plate 11*a* that restricts the leading end, which is the downward end, of the sheet in the sheet feeding direction, and side end restricting plates 14 and 16 that restrict the position of the sheet S in the width direction that is the direction orthogonal to the sheet feeding direction. A slide rail 15 that serves as a guide to draw the sheet storage case 11 is provided.

A trailing end pressing member 17, which is a pressing member for pressing the trailing end of the uppermost sheet Sa from above, is provided to the trailing end restricting plate 13 so as to be slidable in the vertical direction and so as to be swingable. When the trailing end pressing member 17 moves up from a predetermined position in case where the sheet stacked onto the tray 12 is blown up by air blowing, the later-described CPU 1 determines that the top surface of the uppermost sheet is high, whereby it makes a control to lower the tray 12.

The sheet storage case 11 can be drawn from the apparatus body 101 by the slide rail 15. When the sheet storage case 11 is drawn from the apparatus body, the tray 12 lowers to a predetermined position where an operator can replenish or exchange sheets. A sheet feeding mechanism of an air feed type (hereinafter referred to as air feeding mechanism) 150 that separates and feeds the sheet one by one is arranged above the sheet storage case 11. The air feeding mechanism 150 includes an absorption conveyance portion 151 that absorbs and conveys the sheet S stacked onto the tray 12, and a downstream air blowing portion 152 that blows up the upper part of the sheet bundle on the tray for loosening, and separates the sheet S one by one.

The absorption conveyance portion 151 includes an absorption conveyance belt 21 that is looped around a belt driving roller 41 for absorbing and conveying the sheet S in the right direction in the figure, and a suction fan 36 that generates negative pressure for allowing the sheet S to be absorbed onto the absorption conveyance belt 21. The absorption conveyance portion 151 also includes a suction duct 34 that is arranged at the inside of the absorption conveyance belt 21 for suctioning air through unillustrated suction holes formed on the absorption conveyance belt 21. The absorption conveyance portion 151 also includes a suction shutter 37 that is arranged in the suction duct 34 for turning ON or OFF the absorption operation of the absorption conveyance belt 21.

The downstream air blowing portion 152 has a loosening nozzle 33*a* and a separation nozzle 33*b* which blow air to the upper portion of the sheet bundle from the leading end, a loosening fan 32, and a separation duct 33 which sends air from the loosening fan 32 to the nozzles 33*a* and 33*b*. The air taken by the loosening fan 32 passes through the separation duct 33, is blown in the direction of the arrow C by the loosening nozzle 33*a*,and blows up several sheets of the upper portion of the sheets S absorbed by the loosening fan 32 and supported on the tray 12. The air suctioned by the loosening fan 32 is blown in the direction of the arrow D by the separation nozzle 33*b* and separates each of the sheets blown up by the loosening nozzle 33*a* to absorb the uppermost sheet to the absorption conveyance belt 21.

The sheet feeding operation of the sheet feeding apparatus 103 (the air feeding mechanism 150) will next be described. When a user draws out the sheet storage case 11, sets the sheet S, and loads the sheet storage case 11, the tray 12 starts to lift in the direction of an arrow A. When the tray 12 reaches a feedable position where the distance between the uppermost sheet Sa and the absorption conveyance belt 21 becomes B illustrated in FIG. 2, the CPU 1 stops the tray 12 in this position. The CPU 1 waits for a sheet feeding signal for starting the feeding.

Upon the detection of the sheet feeding signal, the CPU 1 operates the loosening fan 32, whereby air is blown to the upstream in the sheet feeding direction from the directions of the arrows C and D, i.e., from the downstream end of the sheet bundle in the sheet feeding direction, by the loosening nozzle 33*a* and the separation nozzle 33*b*. With this operation, the several upper sheets S of the sheet bundle are blown up. The CPU 1 operates the suction fan 36 to discharge air in the direction of the arrow F. In this case, the suction shutter 37 is still closed, so that the uppermost sheet Sa is not absorbed onto the absorption conveyance belt 21.

After a predetermined time is elapsed after the detection of the sheet feeding signal, and the blowing-up of plural upper sheets becomes stable, the CPU 1 drives a later-described absorption solenoid to rotate the suction shutter 37 in the direction of the arrow G. Thus, the air is suctioned from the suction holes formed on the absorption conveyance belt 21, whereby absorption force is generated. The uppermost sheet Sa is absorbed onto the absorption conveyance belt 21 by the absorption force and the separation air from the separation nozzle 33*b*.

Subsequently, the CPU 1 drives a later-described feeding motor to rotate the belt driving roller 41 in a direction of an arrow J. With this operation, the uppermost sheet Sa, which is absorbed onto the absorption conveyance belt 21, is fed in the direction of an arrow K in this state, and then, conveyed to the image forming portion by a pair of pullout rollers 42 rotated in the directions of arrows P and M. A passage sensor 43 is provided at the downstream of the pair of pullout rollers 42, whereby the CPU 1 monitors the passage of the sheet Sa by the passage sensor 43.

A sheet having a small rigidity called an ultrathin sheet having a long length in the sheet feeding direction and a basis weight of 50 g/m$^2$ or less is sometimes fed. When the sheet of this type is fed, there may be the case in which the leading end of the uppermost sheet Sa is pushed toward the downstream in the blowing direction by the loosening air, so that the central part rises and the leading end is shifted backward from the leading end restricting plate 11*a* as described above.

Figure 3:
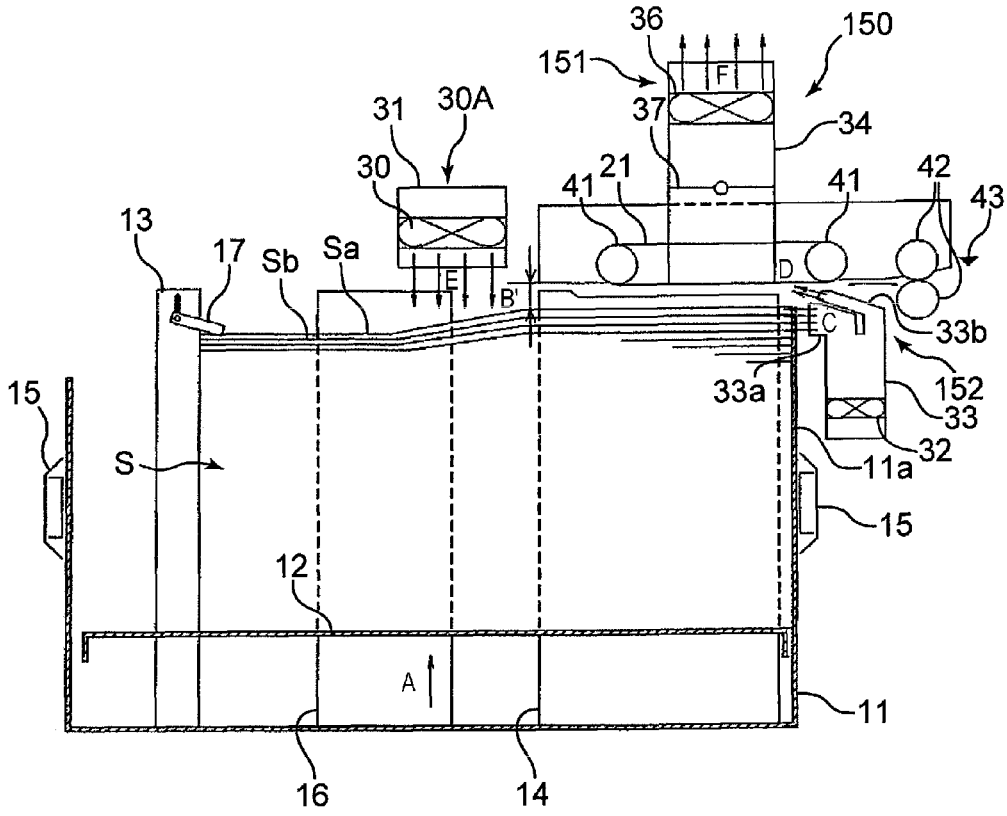
FIG. 3 is a view for describing an operation of an upper air blowing portion provided to the sheet feeding apparatus according to the first exemplary embodiment.

Therefore, an upper air blowing portion 30A, which includes the duct 31 and the blowing fan 30 and serves as a pressure mechanism for blowing air to the central part of the sheet from above the tray 12, is provided above the portion between the trailing end pressing member 17 and the absorption conveyance portion 151. According to the type of the sheet, i.e., when a sheet having a small rigidity is fed, the upper blowing portion 30A is selectively operated to blow air to the sheet from a direction of an arrow E for applying pressure on the sheet as illustrated in FIG. 3.

Since the air is blown to the sheet as described above, the rise of the uppermost sheet Sa at the central part can be prevented, even when force for pushing the uppermost sheet Sa toward the trailing end of the sheet is caused by the loosening air blown to the leading end of the sheet. Thus, the leading end of the sheet is not shifted toward the trailing end of the sheet. Further, even in the case of an ultrathin sheet, the double feed of the uppermost sheet Sa and the following sheet Sb can be prevented. Moreover, the defective feed such as skew feeding, corner bending, or absorption failure, can be reduced.

Figure 4:
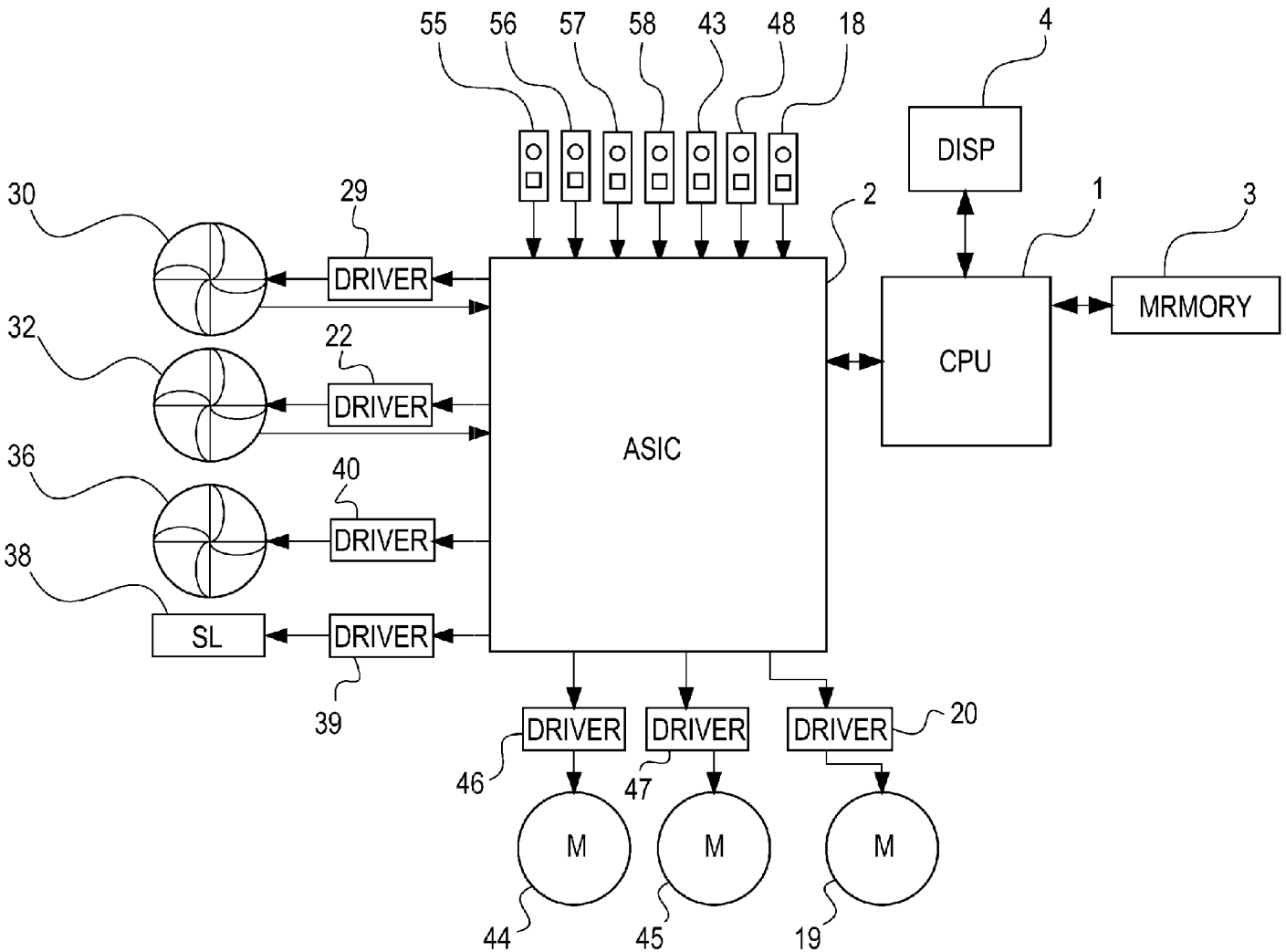
FIG. 4 is a control block diagram for controlling the sheet feeding apparatus according to the first exemplary embodiment.

FIG. 4 is a control block diagram of the sheet feeding apparatus 103 according to the present exemplary embodiment. In FIG. 4, the CPU 1 that is a controlling portion for controlling the sheet feeding apparatus 103 is connected to an exclusive ASIC 2 that outputs an instruction of starting the drive to a drive circuit that drives various loads, such as a motor or a fan, of the sheet feeding apparatus 103 to drive various loads. Connected to the CPU 1 are an operation portion (DISP) 4 serving as an input unit (setting unit) that can input sheet information such as a size, basis weight, or surface property of a sheet, and a storage unit (Memory) 3 that stores various pieces of data input by the operation portion 4, a target value used for the adjustment of the fan, and a PWM value.

The CPU 1 refers to the data stored in the storage unit 3 so as to adjust the distance B between the absorption conveyance belt 21 and the uppermost sheet Sa in the sheet storage case 11 according to the sheet information input by a user from the operation portion 4. Instead of the operation portion 4, an unillustrated detection portion that detects at least one of the sheet-size information, basis-weight information or surface-property information as the sheet information may be provided, and the sheet information may be input to the CPU 1 from the detection portion serving as the input portion.

A sheet storage portion on/off sensor 48 that detects the open/close state of the sheet storage case 11, and a lower position detection sensor 55 and an upper position detection sensor 57 that detect the position of the tray 12 in the sheet storage case 11 are connected to the ASIC 2. A sheet surface detection sensor 18 that detects the top surface of the sheet stacked on the tray 12, and a sheet presence detection sensor 56 that detects the presence of the sheet on the tray 12 are also connected to the ASIC 2. An absorption completion sensor 58 that monitors the negative pressure state in the suction duct 34 so as to detect the completion of the absorption of the sheet when the sheet is absorbed by the suction fan 36, and the passage sensor 43 that detects the movement of the sheet on the conveyance path are also connected to the ASIC 2.

The ASIC 2 outputs a drive start instruction to the drive circuit that drives various loads of the sheet feeding apparatus 103. The ASIC 2 receives revolution signals (FG) of the loosening fan 32, the suction fan 36, and the blowing fan 30 so as to perform a PWM control in order that each fan rotates with a target revolution respectively set. In FIG. 4, a loosening fan drive circuit (driver) 22 transmits a PWM signal output from the ASIC 2 to the loosening fan 32 and makes an electric supply. A suction fan drive circuit (driver) 40 transmits the PWM signal output from the ASIC 2 to the suction fan 36 and makes an electric supply.

A fan drive circuit (driver) 29 transmits the PWM signal output from the ASIC 2 to the blowing fan 30 and makes an electric supply, and a drive circuit (driver) 39 of the suction solenoid 38 opens and closes the suction shutter 37 in the suction duct 34. A drive circuit (driver) 46 drives the feeding motor 44 for driving the belt driving roller 41, and a drive circuit (driver) 47 drives the pullout motor 45 for driving the pair of pullout rollers 42. A drive circuit (driver) 20 drives a lifter motor 19 serving as a lifter drive unit for allowing the tray 12 to lift and lower. In the present exemplary embodiment, the CPU 1, the operation portion 4, and the storage unit 3 are provided to the apparatus body 101, but may be provided to the sheet feeding apparatus 103.

Figure 5:
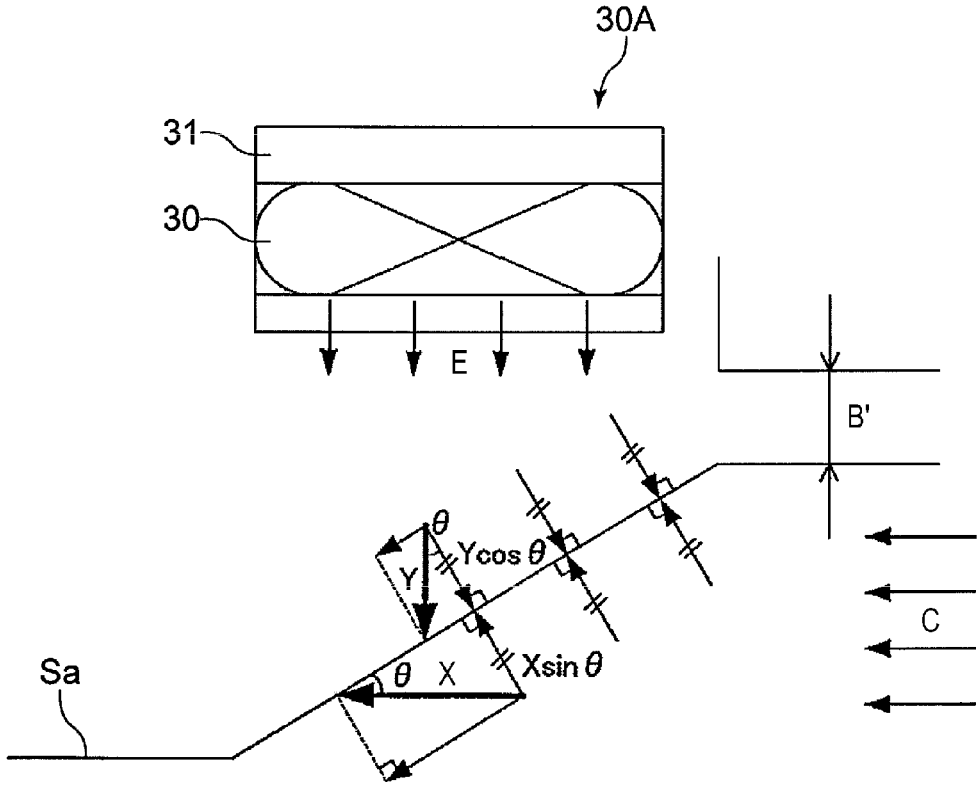
FIG. 5 is a view for describing a relationship of a wind pressure of air blown to the sheet in the sheet feeding apparatus according to the first exemplary embodiment.

FIG. 5 is a view for describing a relationship of a wind pressure between the air blown from the upper air blowing portion 30A, serving as the pressure mechanism, to the tray 12 in the vertical direction in the direction of the arrow E and the loosening air blown horizontally from the leading end of the sheet in the direction of the arrow C on the uppermost sheet Sa. In FIG. 5, Ycos θ is a component force, vertical to the top surface of the trailing end of the uppermost sheet Sa, of the wind pressure Y of the blowing air blown perpendicularly to the tray 12. Xsin θ is a component force, vertical to the top surface of the uppermost sheet, of the wind pressure X of the loosening air blown horizontally to the lower surface of the uppermost sheet Sa at the trailing end.

Figure 20A:
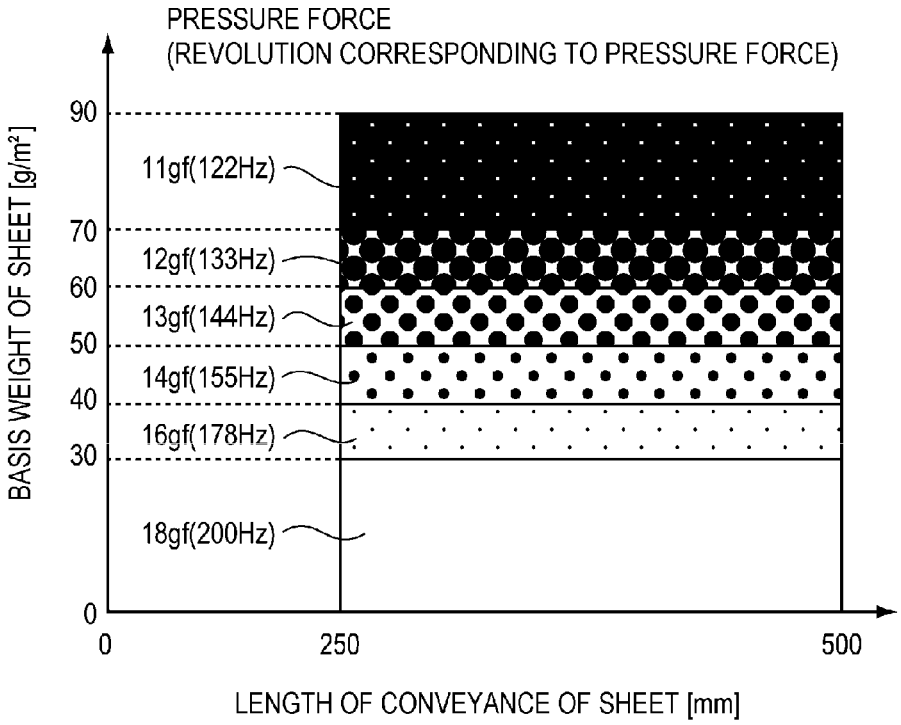
FIGS. 20A and 20B are views for describing data for setting pressure force in the sheet feeding apparatus according to the first exemplary embodiment of the present invention.

In the present exemplary embodiment, the wind pressure Y by the blowing air to the wind pressure of the loosening air is set such that the Ycos θ and Xsin θ establish the equation of Ycos θ=Xsin θ at the respective points of the trailing end of the sheet. The blowing fan 30 is PWM-driven so as to obtain the wind pressure Y. The wind pressure Y by the blowing air to the wind pressure X by the loosening air is stored beforehand in the storage unit 3 for every piece of sheet information such as a sheet size, basis weight, or surface property. The CPU 1 PWM-drives the blowing fan 30 in order that the blowing air has a suitable wind pressure Y according to the sheet information input by the operation portion 4. FIG. 20A illustrates one example of the data involved with the relationship between the sheet information and the blowing fan 30. This data is stored in the storage unit (Memory) 3, whereby the target revolution of the blowing fan 30 according to the input sheet information can be acquired. An axis of ordinate represents a basis weight of a sheet, while an axis of abscissa represents a length of a sheet. The length of the sheet that needs the blowing air is within the range of 250 mm to 500 mm. The necessary revolution (Hz) of the blowing fan 30 to the pressure force (gf) is illustrated within the basis weight of each sheet. The data is obtained from an experiment. However, the data may be obtained based on not only the basis weight of the sheet but also the surface property of the sheet.

Figure 6:
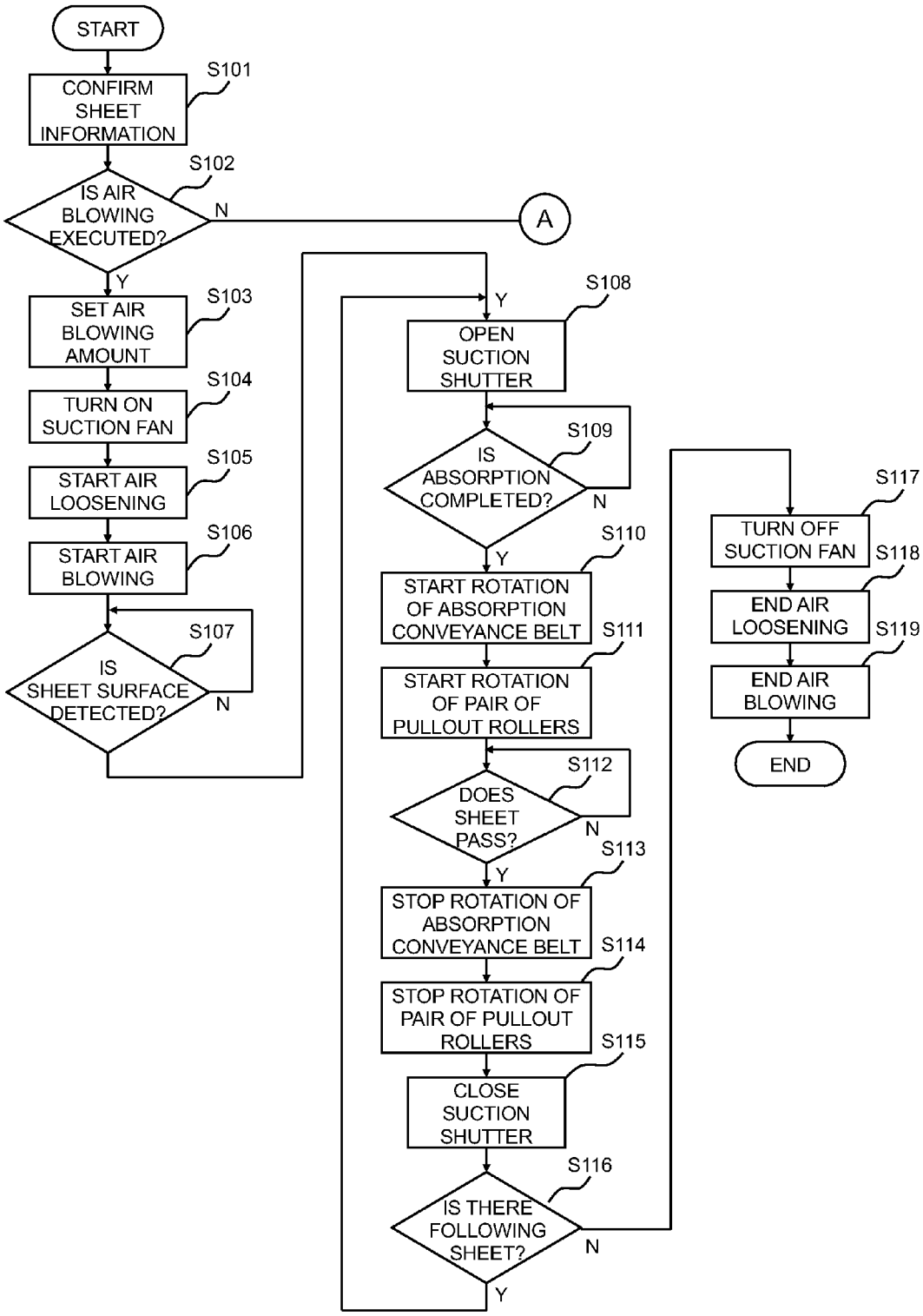
FIG. 6 is a first flowchart for describing the sheet feeding operation of the sheet feeding apparatus according to the first exemplary embodiment.
Figure 7:
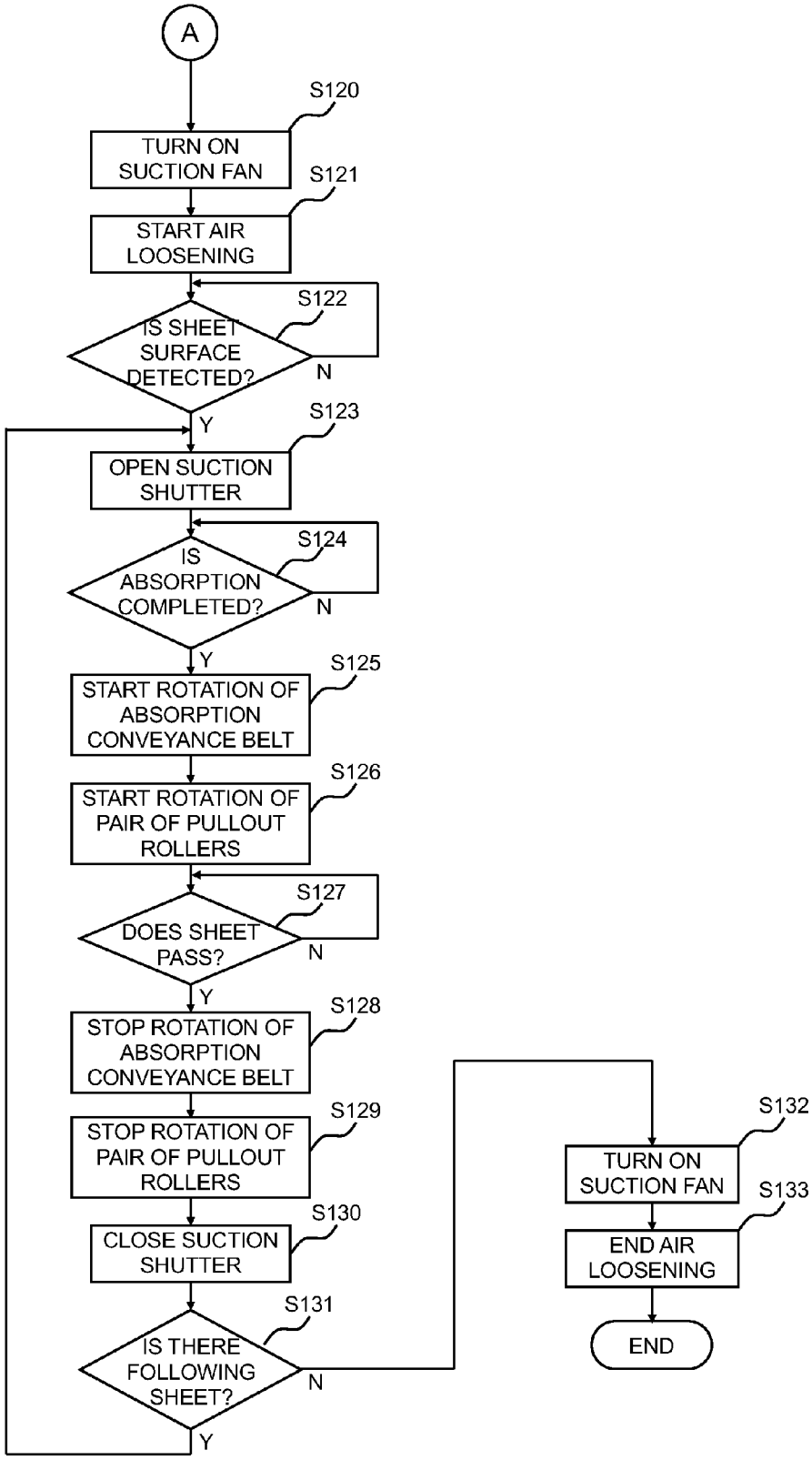
FIG. 7 is a second flowchart for describing the sheet feeding operation of the sheet feeding apparatus according to the first exemplary embodiment.

FIGS. 6 and 7 are flowcharts for describing the sheet feeding operation in the configuration illustrated in the control block diagram in FIG. 4. When sheets are fed, a user draws the sheet storage case 11 for setting a sheet S. After the user loads the sheets into the sheet storage case 11, the tray 12 is lifted by the lifter motor 19, whereby the tray 12 stops at the position (illustrated in FIG. 2) where the distance between the uppermost sheet Sa and the absorption conveyance belt 21 becomes B.

When the CPU 1 then receives the sheet feeding signal, the CPU 1 confirms the sheet information input by the operation portion 4 (S101). Then, the CPU 1 determines whether the air blowing is executed from the upper air blowing portion 30A on the sheet, from the confirmed sheet information and the storage unit 3 storing the sheet information (S102). For example, when the set sheet is an ultrathin sheet, the CPU 1 determines that the air blowing is executed from the upper air blowing portion 30A (Y in step S102), and sets the air blowing amount to the amount according to the sheet information stored in the storage unit 3 (S103).

After the setting of the air blowing amount described above, the CPU 1 inputs a control signal to the suction fan drive circuit 40 to drive (ON) the suction fan 36 (S104). Similarly, the CPU 1 inputs the control signal to the loosening fan drive circuit 22 to drive (ON) the loosening fan 32, thereby starting the air loosening (S105). Further, the CPU 1 inputs the control signal to the blowing fan drive circuit 29 to drive the blowing fan 30, thereby starting the air blowing to the top surface of the uppermost sheet Sa from the upper air blowing portion 30A (S106).

Thereafter, the surface of the uppermost sheet Sa is located on the position where the distance between the uppermost sheet Sa and the absorption conveyance belt 21 becomes B' illustrated in FIG. 3 by the air loosening, and then, the CPU 1 waits for the sheet surface detected by the sheet surface detection sensor 18 (S107). When the sheet surface detection sensor 18 detects the surface of the uppermost sheet Sa (Y in step S107), the CPU 1 inputs the control signal to the suction solenoid drive circuit 39 to drive the suction solenoid 38, thereby opening the suction shutter 37 in the suction duct 34 (S108). Thus, the air is suctioned from the suction holes formed on the absorption conveyance belt 21, whereby absorption force is generated. The uppermost sheet Sa is absorbed onto the absorption conveyance belt 21 by the absorption force and the separation air from the separation nozzle 33*b*.

Then, the CPU 1 monitors the output from the absorption completion sensor 58. When the CPU 1 determines that the absorption of the uppermost sheet Sa is completed (Y in step S109), the CPU 1 inputs the control signal to the feeding motor drive circuit 46 to drive the feeding motor 44, thereby starting the rotation of the absorption conveyance belt 21 (S110). The CPU 1 also inputs the control signal to the pullout motor drive circuit 47 to drive the pullout motor 45, thereby starting the rotation of the pair of pullout rollers 42 (S111). With this process, the sheet is discharged onto the sheet conveyance path.

Thereafter, the CPU 1 monitors the output from the passage sensor 43. When the CPU 1 determines that the sheet discharged onto the sheet conveyance path passes through the passage sensor 43 (Y in step S112), the CPU 1 stops the rotation of the absorption conveyance belt 21 (S113). The CPU 1 also stops the rotation of the pair of pullout rollers 42

(S114), and finally, closes the suction shutter 37 in the suction duct 34 (S115). With this process, the feed of the uppermost sheet is completed.

When there are plural sheets to be fed, and the following sheet is fed, i.e., when there is a following sheet (Y in step S116), the CPU 1 returns to step S108 to execute the similar process. When there is no following sheet (N in step S116), i.e., when the feeding operation is completed, the CPU 1 inputs the control signal to the suction fan drive circuit 40 to stop (OFF) the suction fan 36 (S117). Similarly, the CPU 1 inputs the control signal to the loosening fan drive circuit to stop the loosening fan 32, thereby ending the air loosening (S118). The CPU 1 also inputs the control signal to the blowing fan drive circuit to stop (OFF) the blowing fan 30, thereby ending the air blowing (S119).

When the air blowing is not executed (N in step S102), the CPU 1 performs processes in steps S120 to S133, which are similar to the processes in steps S104 to S118 excluding the above-mentioned air blowing amount setting process in step S103, the air blowing starting process in step S106, and the air blowing ending process in step S119.

As described above, when the sheet moves in the direction reverse to the sheet feeding operation in case where the loosening air is blown to the sheet from the leading end of the sheet, the upper air blowing portion 30A serving as the pressure mechanism is driven to blow air to the top surface of the sheet in order to apply pressure on the top surface of the uppermost sheet. As a result, the movement of the uppermost sheet toward the trailing end of the sheet with the air blown from the leading end of the sheet can be suppressed, whereby a defective feeding such as the double feed of the uppermost sheet and the lower sheet, which is exposed by the movement of the uppermost sheet, skew feeding, corner bending, or absorption failure can be reduced.

In the first exemplary embodiment, after the loosening fan 32 is driven (ON) to start the air loosening (S105), the blowing fan 30 is driven to start the air blowing to the top surface of the uppermost sheet Sa from the upper air blowing portion 30A (S106). The control of the operation timing of the air loosening and the air blowing in order to more promptly suppress the rise of the sheet by the air blowing from the upper air blowing portion 30A will next be described.

Since the air blowing amount from the upper air blowing portion 30A is smaller than that from the downward air blowing portion 152, the air blown from the upper air blowing portion 30A might be affected by the air blown from the downward air blowing portion 152. When the air blowing from the upper air blowing portion 30A and the air blowing from the downward air blowing portion 152 are simultaneously performed, it takes much time to stabilize the air blowing amount from the upper air blowing portion 30A. In view of this, after the amount of the air blown from the upper air blowing portion 30A is stabilized, the blowing from the downward air blowing portion 152 is started.

Figure 8:
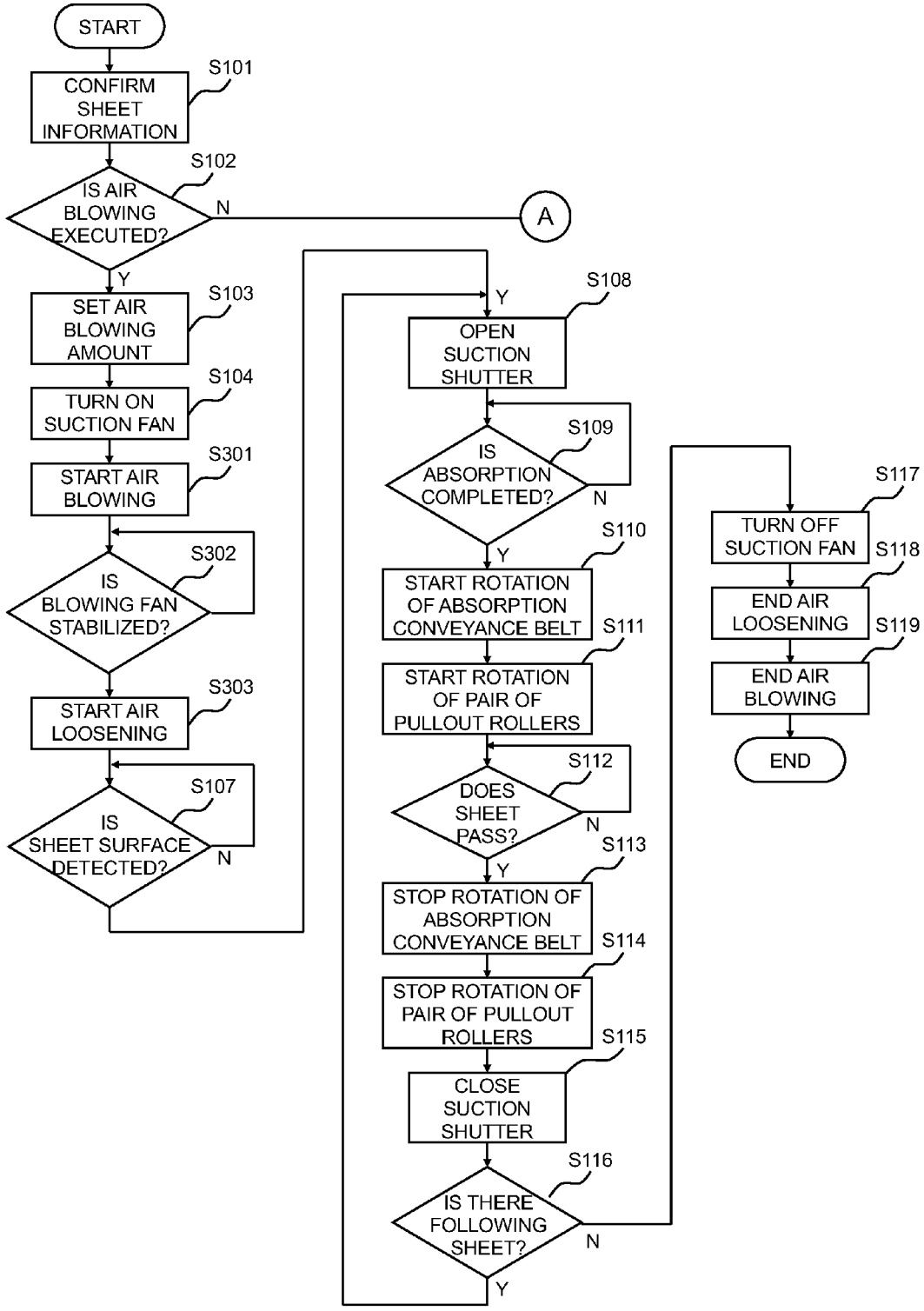
FIG. 8 is a flowchart illustrating an example of a modification of the first exemplary embodiment.

This operation will be described with reference to the flowchart in FIG. 8. In the flowchart in FIG. 8, the processes between the process of "turn ON suction fan" (S104) and the process of "is sheet surface detected?" (S107) are different from the flowcharts in FIGS. 6 and 7, so that the different portions will be described. The other processes are the same as those in the flowcharts in FIGS. 6 and 7, so that the description will not be repeated.

When the CPU 1 turns ON the suction fan (S104) and inputs the control signal to the blowing fan drive circuit, the CPU 1 drives the blowing fan 30 at the upper air blowing portion 30A (S301). The CPU 1 receives the revolution signal (FG) from the blowing fan 30, and makes a PWM control in order that the fan rotates with the target revolution. Then, the CPU 1 waits until the rotation state of the fan 30 is stabilized (S302). After the rotation of the blowing fan 30 of the upper air blowing portion 30A is stabilized, the CPU 1 inputs the control signal to the loosening fan drive circuit to drive the loosening fan 32 of the downward air blowing portion 152, thereby starting the air loosening (S303). The CPU 1 waits for the sheet surface detected by the sheet surface detection sensor 18 (S107). After that, the operation proceeds according to the flowcharts in FIGS. 6 and 7.

With this control, the air is blown to the top surface of the sheet in the stabilized state at the point of starting the blowing of the loosening air, resulting in that the rise of the sheet, which is caused because the sheet is pushed toward the trailing end of the sheet by the loosening air, can surely be prevented.

Figure 19:
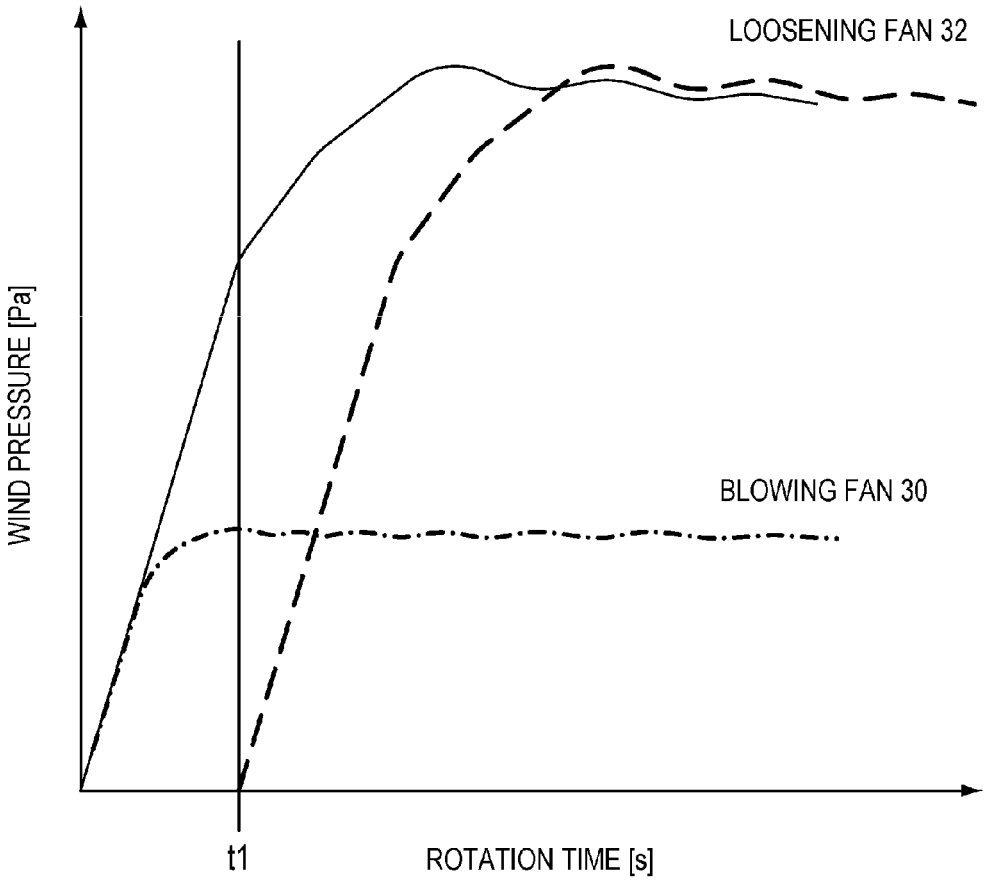
FIG. 19 is a view for describing a relationship of a wind pressure of air blown to the sheet in the sheet feeding apparatus.

FIG. 19 is one example of a characteristic graph representing the relationship between the set wind pressure and the rotation time of the loosening fan 32 and the blowing fan 30. The set wind pressure in the characteristic graph assumes a value corresponding to the wind pressure defined by a predetermined measurement method in the fan duct. As described above, the set wind pressure of the loosening fan 32 is changed for every piece of sheet information such as the sheet size, the basis weight, and the surface property, wherein the set value of the blowing fan 30 becomes a sufficiently small value as indicated in the graph even in any sheet information. This is because the air of the loosening fan 32 is blown to the leading end of the sheet, and as the air passes toward the trailing end of the sheet, so that the wind pressure is decreased.

It is found that, since the air blowing fan 30 has a small set wind pressure, the rotation time until it reaches the predetermined wind pressure is sufficiently smaller than that of the loosening fan 32. Accordingly, it is found that, when the loosening fan 32 starts to rotate after the start of the rotation of the blowing fan 30, the loosening fan 32 reaches the set wind pressure after the blowing fan 30 is in the stabilized wind pressure. In view of this, it is controlled in the present exemplary embodiment such that the drive of the loosening fan 32 is started after a lapse of time t1 at which the blowing fan 30 has a stabilized wind pressure, in order to secure more stability. The time t1 is set beforehand from the experiment according to the sheet information such as the sheet size, the basis weight, and the surface property.

Next, a second exemplary embodiment of the present invention will be described with reference to FIGS. 9 and 10. The second exemplary embodiment has a configuration for stabilizing the conveyance property when the sheet is absorbed and conveyed by the absorption conveyance portion 151 of the sheet feeding apparatus provided with the upper air blowing portion 30A in the first exemplary embodiment illustrated in FIG. 2.

When air is blown to the top surface of the uppermost sheet Sa from the upper air blowing portion 30A, downward force is applied on the sheet Sa by the air. Therefore, when the sheet Sa is absorbed and conveyed by the absorption conveyance portion 151 with the air being blown from the upper air blowing portion 30A, the conveyance load is generated to the sheet Sa, which might prevent the sheet from having a stable conveyance property. In view of this, in the present exemplary embodiment, the air blowing amount from the upper air blowing portion 30A is adjusted to be capable of performing a stable absorption conveyance of the sheet.

Specifically, the upper air blowing portion 30A can blow the air with a first wind pressure controlled to apply pressure on the top surface of the uppermost sheet with a predetermined pressure force and a second wind pressure controlled to apply pressure on the sheet with a pressure force smaller than the pressure force by the first wind pressure. After receiving the sheet feed start signal, the CPU 1 starts the control in which the upper air blowing portion 30A blows the air with the first wind pressure. The CPU 1 also changes the air to be blown from the upper air blowing portion 30A with the second wind pressure from the first wind pressure during the period from the start of the absorption of the sheet by the absorption conveyance portion 151 to the start of the conveyance of the sheet by the absorption conveyance portion 151. The pressure force applied on the top surface of the uppermost sheet by the air blowing with the second wind pressure is set to be small to a degree in which it does not become the conveyance load to the sheet.

Figure 9:
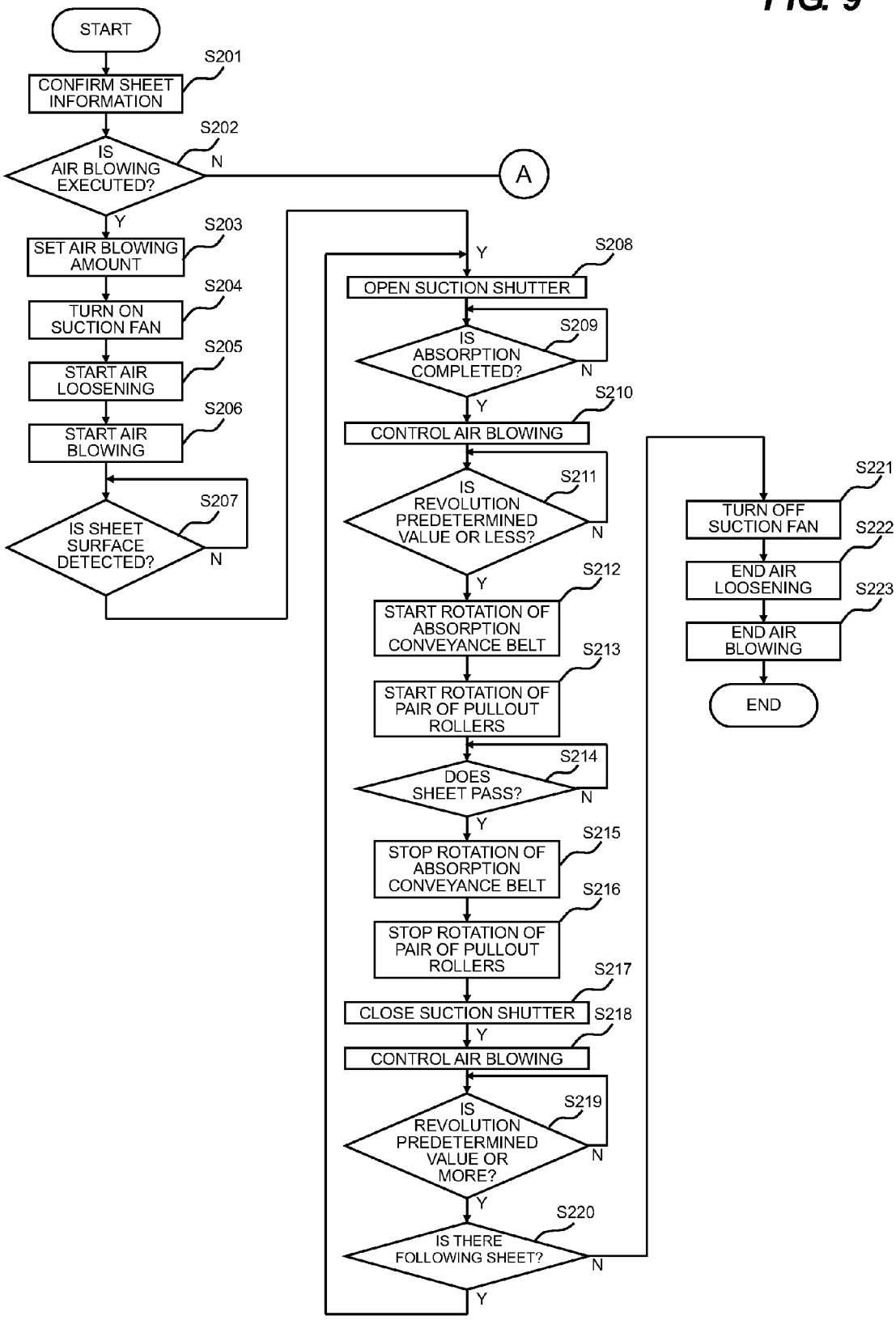
FIG. 9 is a first flowchart for describing a sheet feeding operation of a sheet feeding apparatus according to a second exemplary embodiment of the present invention.
Figure 10:
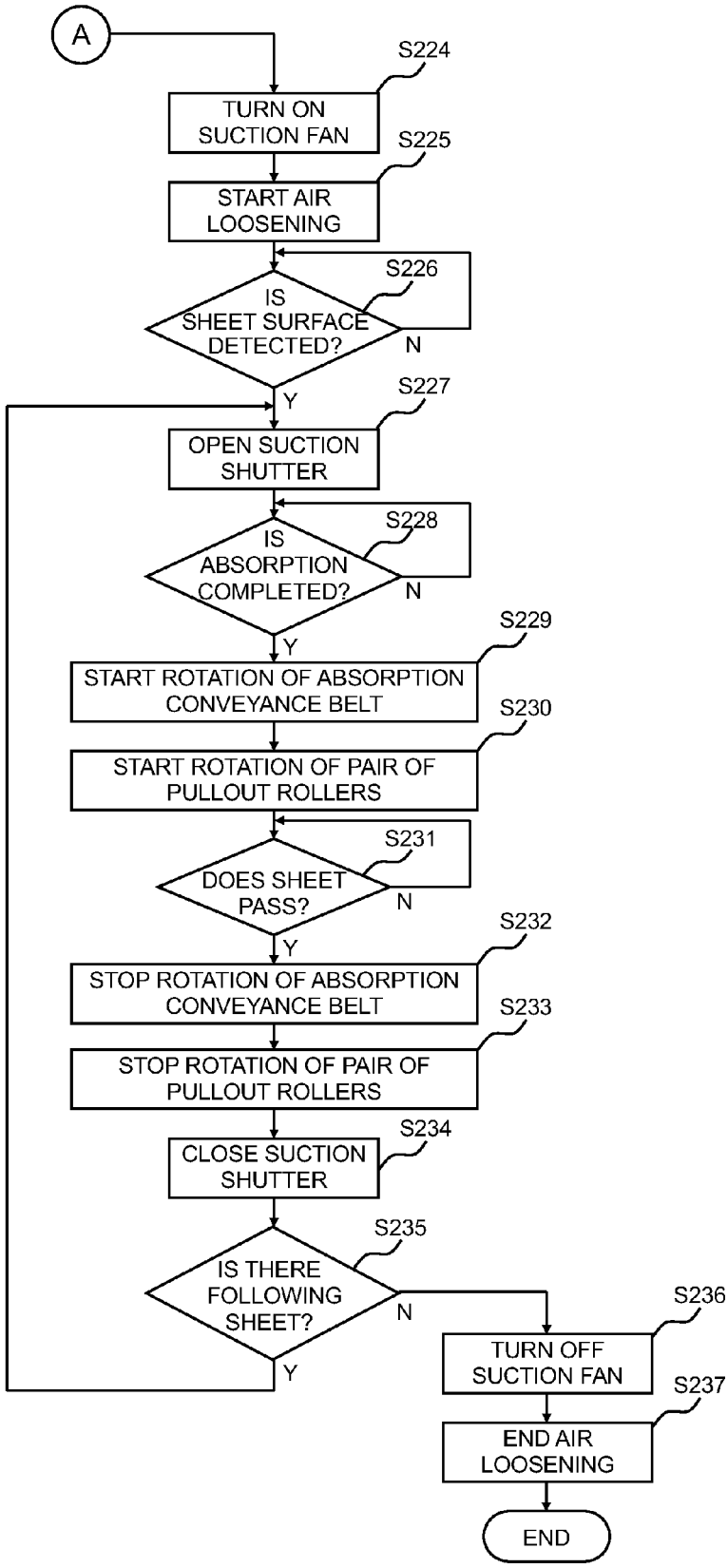
FIG. 10 is the second flowchart for describing the sheet feeding operation of the sheet feeding apparatus according to the second exemplary embodiment.

FIGS. 9 and 10 are flowcharts of the control in the second exemplary embodiment, and they are controlled in the configuration of the control block diagram illustrated in FIG. 4.

After receiving the sheet feeding signal, the CPU 1 confirms the sheet information input by the operation portion 4 (S201). Then, the CPU 1 determines whether the air blowing is executed from the upper air blowing portion 30A on the sheet, from the confirmed sheet information and the storage unit 3 storing the sheet information (S202). For example, when the set sheet is an ultrathin sheet, the CPU 1 determines that the air blowing is executed from the upper air blowing portion 30A (Y in step S202), and sets the air blowing amount to the amount according to the sheet information stored in the storage unit 3 (S203). In this case, the CPU 1 refers to the basis weight-pressure force of the sheet illustrated in FIG. 20A from the storage unit 3, thereby setting the revolution of the air blowing fan 30 corresponding to the pressure force. The wind pressure blown from the air blowing fan 30 with the set revolution is the first wind pressure.

After the air blowing amount by the upper air blowing portion 30A is set as described above, the CPU 1 inputs the control signal to the suction fan drive circuit 40 to drive (ON) the suction fan 36 (S204). Similarly, the CPU 1 inputs a control signal to the loosening fan drive circuit 22 to drive (ON) the loosening fan 32, thereby starting the air loosening (S205). Further, the CPU 1 inputs the control signal to the blowing fan drive circuit 29 to drive the blowing fan 30, thereby starting the air blowing to the top surface of the uppermost sheet Sa from the upper air blowing portion 30A (S206). The air blowing from the upper air blowing portion 30A is set such that an air volume thereof becomes a first air volume.

Thereafter, the surface of the uppermost sheet Sa is located on the position where the distance between the uppermost sheet Sa and the absorption conveyance belt 21 becomes B' illustrated in FIG. 3 by the air loosening, and then, the CPU 1 waits for the sheet surface detected by the sheet surface detection sensor 18 (S207). When the sheet surface detection sensor 18 detects the surface of the uppermost sheet Sa (Y in step S207), the CPU 1 inputs the control signal to the suction solenoid drive circuit 39 to drive the suction solenoid 38, thereby opening the suction shutter 37 in the suction duct 34 (S208). In this manner, air is suctioned from the suction holes formed on the absorption conveyance belt 21 to generate an absorption force for absorbing the sheet. The uppermost sheet Sa is absorbed onto the absorption conveyance belt 21 by the absorption force and the separation air from the separation nozzle 33*b*.

Figure 20B:
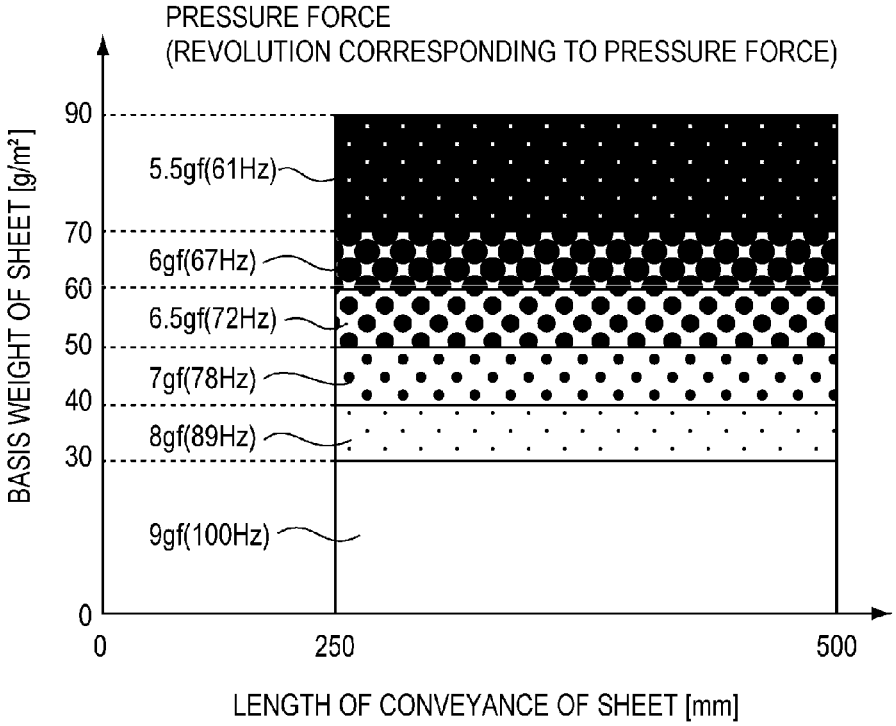

Then, the CPU 1 monitors the output from the absorption completion sensor 58. When the CPU 1 determines that the absorption of the uppermost sheet Sa is completed (Y in step S209), the CPU 1 controls the blowing fan 30 to have the predetermined second wind pressure (S210). The wind pressure of the air blown from the blowing fan 30 after the completion of the absorption is set based on a table illustrated in FIG. 20B, for example. The PWM signal input to the blowing fan 30 is controlled based on the table, so that the revolution of the blowing fan 30 is controlled to be the predetermined revolution or less. The table in FIG. 20B is obtained by the experiment, like the table illustrated in FIG. 20A. The wind pressure of the air blown from the blowing fan 30 is the second wind pressure that is smaller than the first wind pressure, wherein the pressure force applied on the top surface of the uppermost sheet by the air blowing with the second wind pressure is set to be small to a degree in which pressure force does not become the conveyance load to the sheet.

When the revolution of the blowing fan 30 becomes the predetermined revolution or less (Y in step S211), the CPU 1 inputs the control signal to the feeding motor drive circuit 46 to drive the feeding motor 44, thereby rotating the absorption conveyance belt 21 in the direction of an arrow J in FIG. 2 (S212). The CPU 1 also inputs the control signal to the pullout motor drive circuit 47 to drive the pullout motor 45, thereby starting the rotation of the pair of pullout rollers 42 in the directions of P and M in FIG. 5 (S213). With this process, the sheet is discharged onto the sheet conveyance path. When the revolution of the blowing fan 30 does not become the predetermined revolution or less (N in step S211), the CPU 1 waits until the blowing fan 30 reaches the predetermined revolution.

Thereafter, the CPU 1 monitors the output from the passage sensor 43. When the CPU 1 determines that the sheet discharged onto the sheet conveyance path passes through the passage sensor 43 (Y in step S214), the CPU 1 stops the rotation of the absorption conveyance belt 21 (S215). The CPU 1 also stops the rotation of the pair of pullout rollers 42 (S216), and finally, closes the suction shutter 37 in the suction duct 34 (S217).

It is controlled such that the revolution of the blowing fan 30 becomes the predetermined revolution or more by the PWM signal, for example, in order that the wind pressure of the blowing fan 30 again becomes the initial wind pressure (S218). When the revolution of the blowing fan 30 becomes the predetermined revolution or more (Y in step S219), the CPU 1 determines whether there is a following sheet to be fed (S120). When there are plural sheets to be fed, and the following sheet is to be fed (Y in step S220), the CPU 1 returns to step S108 to perform the similar process. When there is no following sheet (N in step S220), and the feeding operation is ended, the CPU 1 inputs the control signal to the suction fan drive circuit 40 to stop the suction fan 36 (S221). Similarly, the CPU 1 inputs the control signal to the loosening fan drive circuit to stop the loosening fan 32 (S222), and then, the CPU 1 inputs the control signal to the blowing air fan drive circuit to stop the blowing air fan 30. Thus, the air blowing is ended.

When the air blowing by the upper air blowing portion 30A is not executed (N in step S202), the CPU 1 performs processes in steps S124 to S137, which are similar to the processes in steps S204 to S218 excluding the above-mentioned air blowing amount setting process in step S203, the air blowing starting process in step S206, and the air blowing ending process in step S219.

In the present exemplary embodiment, the control of the blowing fan 30 (S210) is executed after the completion of the absorption based on the detection by the absorption completion sensor 58 (S209). However, the control of the blowing fan 30 may be executed during the period from the open of the suction shutter 37 (S208) to the start of the operation of the absorption conveyance belt 21 (S212). Specifically, the applied pressure by the upper air blowing portion 30A may be changed from the pressure with the first air volume to the pressure with the second air volume during the period from the start of the absorption of the sheet by the absorption conveyance belt 21 to the start of the conveyance of the sheet by the absorption conveyance belt 21.

In step S218, the wind pressure of the blowing fan 30 is controlled again to be the initial wind pressure. However, the control of the blowing fan 30 may be started depending on the conveying distance and time by the absorption conveyance belt in step S212.

Figure 11:
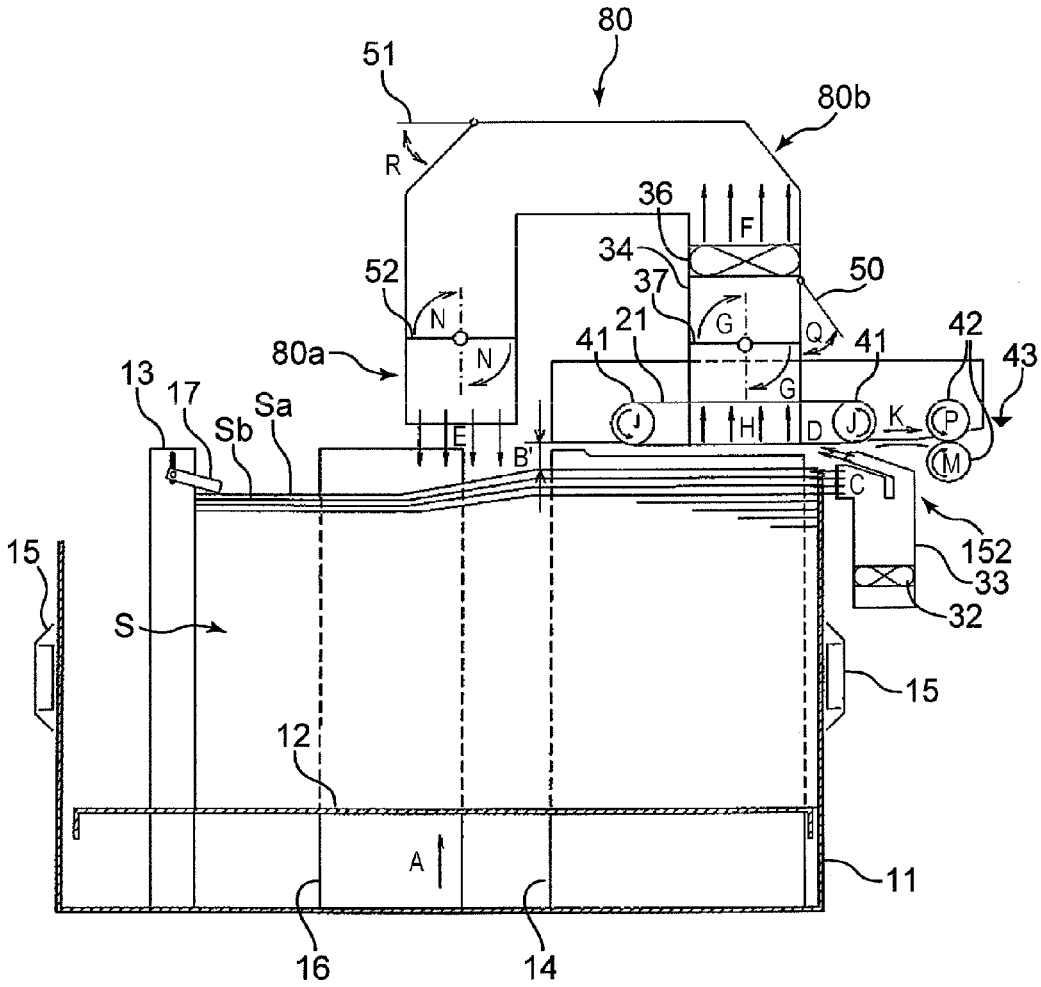
FIG. 11 is a sectional view illustrating a configuration of a sheet feeding apparatus according to a third exemplary embodiment of the present invention.

A third exemplary embodiment of the present invention will next be described. FIG. 11 is a view illustrating a configuration of a sheet feeding apparatus according to the third exemplary embodiment of the present invention. In FIG. 11, the symbols same as those in FIG. 2 indicate the same or equivalent portions. The sheet feeding apparatus according to the third exemplary embodiment is also controlled in the configuration of the control block diagram in FIG. 4.

In FIG. 11, an upper air blowing portion 80 serves as a pressure mechanism in the present invention. The upper air blowing portion 80 has an air blowing portion 80*a* at the upstream of the absorption conveyance portion 151 in the sheet feeding direction, wherein air is blown to the sheet on the tray 12 from the air blowing portion 80*a*. The air blowing portion 80 includes a communicating duct 80*b* that communicates with the suction duct 34 that suctions the suction air by the suction fan 36, and a blowing shutter 52 that rotates in the direction of N by an unillustrated drive unit during the air blowing so as to open the air blowing portion 80*a*.

In the third exemplary embodiment, the blowing shutter 52 is opened according to the sheet information, whereby the air suctioned by the suction fan 36 is blown to the position where the movement of the uppermost sheet toward the trailing end of the sheet with the loosening air can be suppressed.

In the third exemplary embodiment, a first opening/closing member 50 for opening and closing an unillustrated first suction duct opening is provided between the suction fan 36 and the suction shutter 37 in the suction duct 34. A second opening/closing member 51 for opening and closing an unillustrated second suction duct opening is provided between the suction fan 36 and the blowing shutter 52 of the communication duct 80*b*. When the CPU 1 determines that the blowing air is unnecessary according to the sheet information, the CPU 1 opens the second opening/closing member 51 in the direction of R so as to exhaust the air, suctioned in the direction of F by the suction fan 36, from the second suction duct opening. When the CPU 1 determines that the air blowing is necessary according to the sheet information, and when the suction shutter 37 is closed, the CPU 1 opens the first opening/closing member 50 in the direction of Q so as to exhaust the air, suctioned in the direction of F by the suction fan 36, from the air blowing portion 80*a*.

Figure 12:
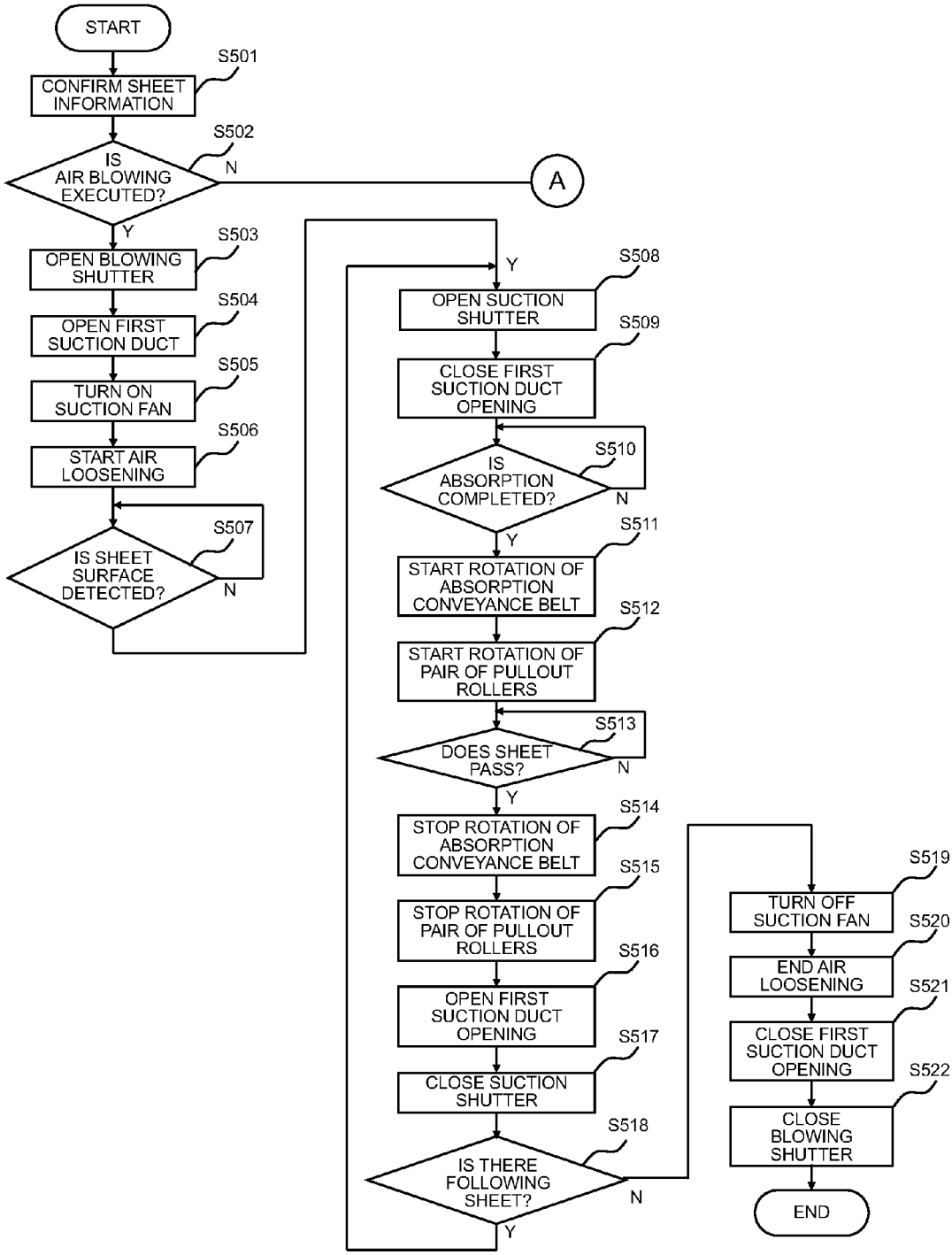
FIG. 12 is a first flowchart for describing the sheet feeding operation of the sheet feeding apparatus according to the third exemplary embodiment.
Figure 13:
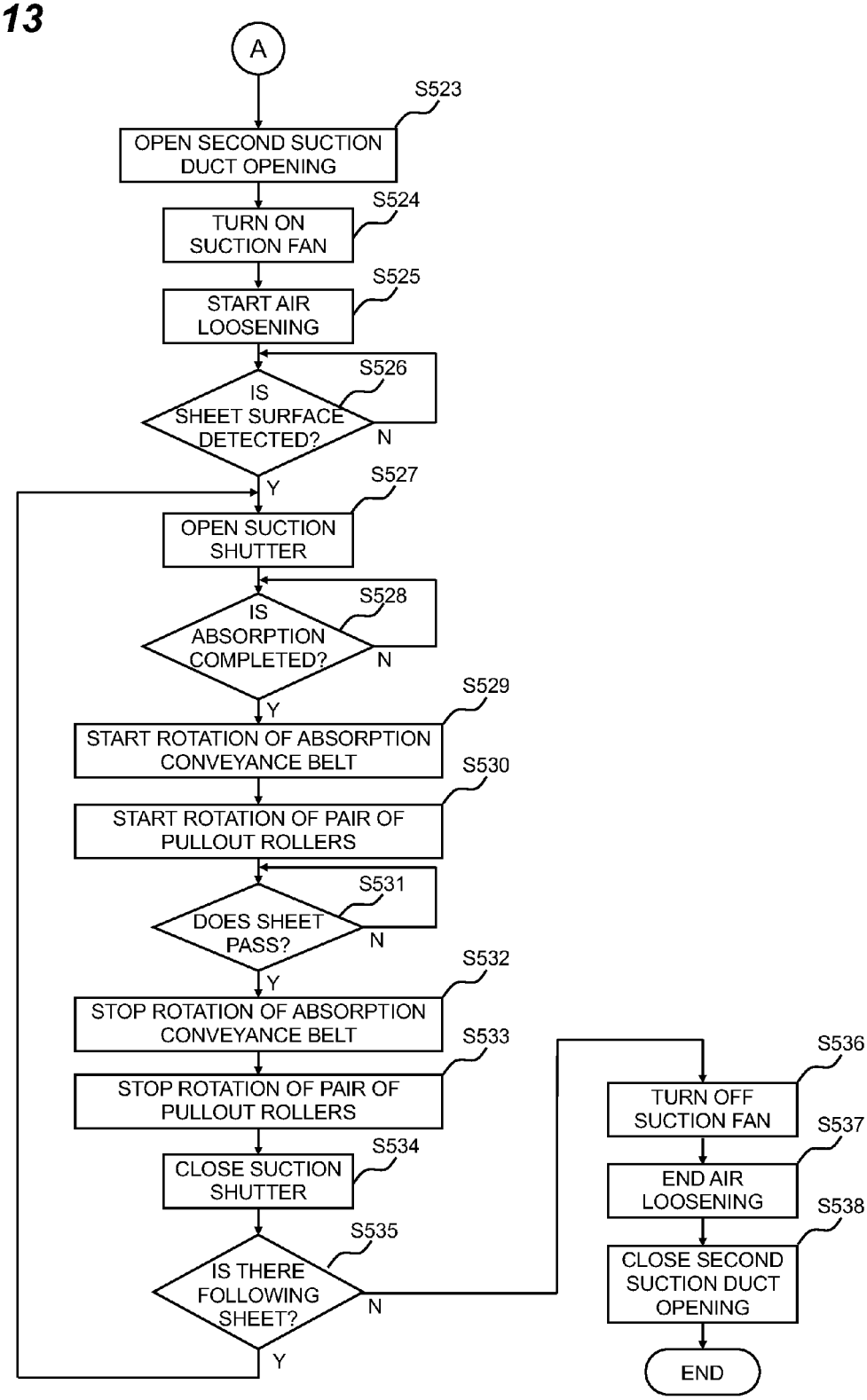
FIG. 13 is a second flowchart for describing the sheet feeding operation of the sheet feeding apparatus according to the third exemplary embodiment.

FIGS. 12 and 13 are flowcharts for describing the sheet feeding operation of the sheet feeding apparatus 103 according to the present exemplary embodiment. When a user draws out the sheet storage case 11, sets the sheet S, and loads the sheets into the sheet storage case 11, in order to feed the sheet, the tray 12 starts to be lifted by the lifter motor 19. Therefore, the tray 12 stops at the position (illustrated in FIG. 2) where the distance between the uppermost sheet Sa and the absorption conveyance belt 21 becomes B.

After receiving the sheet feeding signal, the CPU 1 confirms the sheet information input by the operation portion 4 (S501). Then, the CPU 1 determines whether the air blowing is executed on the sheet, from the confirmed sheet information and the storage unit 3 storing the sheet information (S502). For example, when the set sheet is an ultrathin sheet, the CPU 1 determines that the air blowing is executed (Y in step S502), and opens the blowing shutter 52 by rotating the same in the direction of N in FIG. 12 (S503). With this process, the air blowing portion 80*a* is opened. Since the suction shutter 37 is not opened in this case, the first opening/closing member 50 is opened to open the first suction duct opening (S504). Thus, the air is blown from the air blowing portion 80*a*.

Next, the CPU 1 drives (ON) the suction fan 36 (S505). Similarly, the CPU 1 drives (ON) the loosening fan 32 to start the air loosening (S506). Thereafter, the surface of the uppermost sheet Sa is located on the position where the distance between the uppermost sheet Sa and the absorption conveyance belt 21 becomes B' illustrated in FIG. 11 by the air loosening, and then, the CPU 1 waits for the sheet surface detected by the sheet surface detection sensor 18 (S507). When the sheet surface detection sensor 18 detects the surface of the uppermost sheet Sa (Y in step S507), the CPU 1 opens the suction shutter 37 in the suction duct 34 (S508). The CPU 1 closes the first opening/closing member 50, which has been opened before that, to close the first suction duct opening. Thus, the air is suctioned from the suction holes formed on the absorption conveyance belt 21, whereby absorption force is generated. Only the uppermost sheet Sa is absorbed onto the absorption conveyance belt 21 by the absorption force and the separation air from the separation nozzle 33*b*.

Then, the CPU 1 monitors the output from the absorption completion sensor 58. When the CPU 1 determines that the absorption of the uppermost sheet Sa is completed (Y in step S510), the CPU 1 drives the feeding motor 44 so as to start the rotation of the absorption conveyance belt 21 (S511). The CPU 1 also starts the rotation of the pair of pullout rollers 42 (S512). With this process, the sheet is discharged onto the sheet conveyance path. Thereafter, the CPU 1 monitors the output from the passage sensor 43. When the CPU 1 determines that the sheet discharged onto the sheet conveyance path passes through the passage sensor 43 (Y in step S513), the CPU 1 stops the rotation of the absorption conveyance belt 21 (S514). The CPU 1 also stops the rotation of the pair of pullout rollers 42 (S515), opens the first suction duct opening (S516), and finally, closes the suction shutter 37 in the suction duct 34 (S517). With this process, the feed of the uppermost sheet is completed.

When there are plural sheets to be fed, and the following sheet is fed, i.e., when there is a following sheet (Y in step S518), the CPU 1 returns to step S508 to execute the similar process. When there is no following sheet (N in step S518), i.e., when the feeding operation is completed, the CPU 1 stops (OFF) the suction fan 36 (S519). Similarly, the CPU 1 stops the loosening fan 32 to end the air loosening (S520). The CPU 1 also closes the first suction duct opening (S521), and finally closes the blowing shutter 52 (S522) to end the air blowing.

When the air blowing is not executed (N in step S502), the CPU 1 firstly opens the second opening/closing member 51 to open the second suction duct opening (S523). Thereafter, the CPU 1 drives (ON) the suction fan 36 (S524). Similarly, the CPU 1 drives (ON) the loosening fan 32 to start the air loosening (S525). Thereafter, the surface of the uppermost sheet Sa is located on the position where the distance between the uppermost sheet Sa and the absorption conveyance belt 21 becomes B' illustrated in FIG. 11 by the air loosening, and then, the CPU 1 waits for the sheet surface detected by the sheet surface detection sensor 18 (S526). When the sheet surface detection sensor 18 detects the surface of the uppermost sheet Sa (Y in step S526), the CPU 1 inputs the control signal to the suction solenoid drive circuit 39 to drive the suction solenoid 38, thereby opening the suction shutter 37 in the suction duct 34 (S527). Thus, the air is suctioned from the suction holes formed on the absorption conveyance belt 21, whereby absorption force is generated. Only the uppermost sheet Sa is absorbed onto the absorption conveyance belt 21 by the absorption force and the separation air from the separation nozzle 33*b*.

Then, the CPU 1 monitors the output from the absorption completion sensor 58. When the CPU 1 determines that the absorption of the uppermost sheet Sa is completed (Y in step S528), the CPU 1 starts the rotation of the absorption conveyance belt 21 (S529). The CPU 1 also starts the rotation of the pair of pullout rollers 42 (S530). With this process, the sheet is discharged onto the sheet conveyance path. Thereafter, when the CPU 1 determines that the sheet discharged onto the sheet conveyance path passes through the passage sensor 43 (Y in step S531), the CPU 1 stops the rotation of the absorption conveyance belt 21 (S532). The CPU 1 also stops the rotation of the pair of pullout rollers 42 (S533), and closes the suction shutter 37 (S534). With this process, the feed of the uppermost sheet is completed.

When there are plural sheets to be fed, and the following sheet is fed, i.e., when there is a following sheet (Y in step S535), the CPU 1 returns to step S523 to execute the similar process. When there is no following sheet (N in step S535), i.e., when the feeding operation is completed, the CPU 1 stops (OFF) the suction fan 36 (S536). Similarly, the CPU 1 stops the loosening fan 32 to end the air loosening (S537). The CPU 1 also closes the second suction duct opening (S538) to end the sheet feeding operation.

As described above, according to the third exemplary embodiment, the suction air by the suction fan 36 is used for the air blowing, so that the blowing air can be blown to the top surface of the uppermost sheet with a cheap configuration. Thus, a defective feeding such as the double feed of the uppermost sheet and the lower sheet, which is exposed by the movement of the uppermost sheet, skew feeding, corner bending, or absorption failure can be reduced.

The configuration of a sheet feeding apparatus according to a fourth exemplary embodiment of the present invention will be described in detail with reference to FIG. 14. The symbols same as those in FIG. 2 illustrating the first exemplary embodiment indicate the same or equivalent portions.

Figure 14:
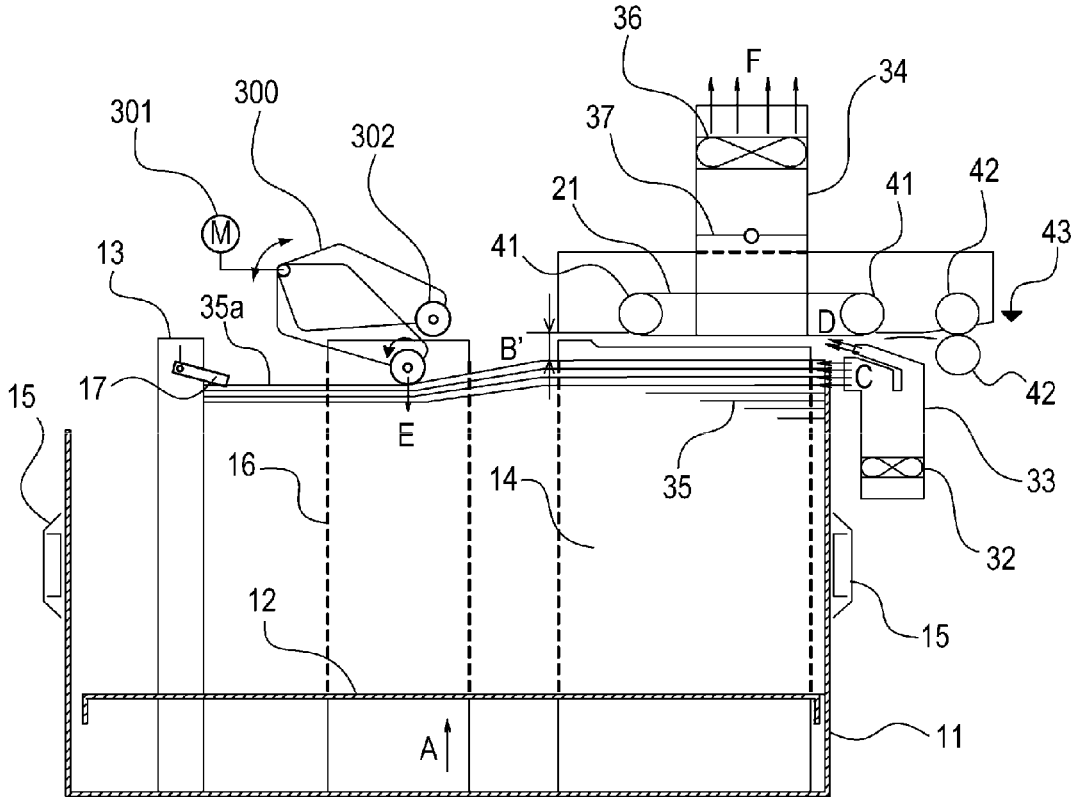
FIG. 14 is a view illustrating a configuration of a sheet feeding apparatus according to a fourth exemplary embodiment of the present invention.

In FIG. 14, instead of the air blowing unit including the blowing fan 30, the blowing duct 31, and the like in the first exemplary embodiment, a pressure portion 300 serving as the pressure mechanism for applying pressure in the direction of E is used in the present exemplary embodiment. The other portions are the same as those in the first exemplary embodiment, so that the description will not be repeated.

Figure 21A:
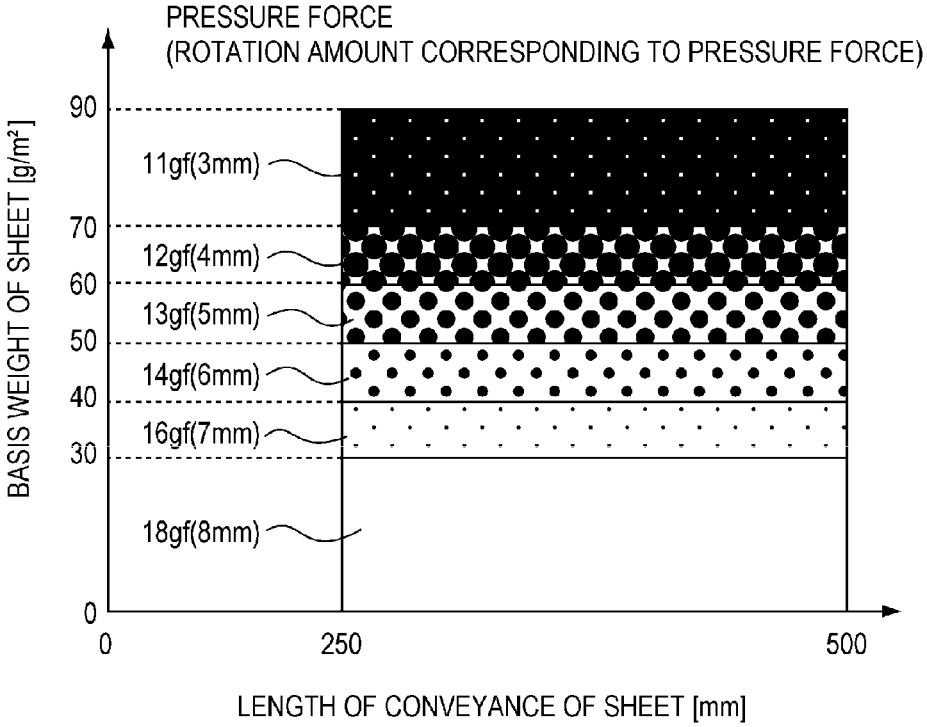
FIGS. 21A and 21B are views for describing data for setting pressure force in the sheet feeding apparatus according to the fourth exemplary embodiment of the present invention.

The pressure portion 300 includes a pressure motor 301 serving as a moving mechanism, and a pressure roller 302 serving as a pressure member. When the pressure motor 301 rotates, the pressure roller 302 swings downward to apply pressure on the top surface of the stacked sheet from above the tray 12. When the pressure application is not needed, the pressure roller 302 waits at the separating position where the pressure roller 302 is separated from the uppermost sheet Sa by the pressure motor 301. As described above, the pressure roller 302 can move by the pressure motor 301 between the position where the pressure roller 302 applies pressure on the top surface of the uppermost sheet Sa and the separation position where the pressure roller 32 is separated from the top surface of the sheet. The movement of the uppermost sheet toward the trailing end of the sheet can be suppressed by the pressure force applied on the top surface of the uppermost sheet Sa by the pressure portion 300, even when the force of pushing the sheet toward the trailing end of the sheet is generated by the loosening air blown toward the leading end of the sheet (in the direction of C). The pressure force by the pressure portion 300 in this case is adjusted depending on the type of the sheet. The magnitude of the pressure force is set such that the proper target rotation amount of the pressure motor 301 is selected based on the data stored in the storage unit (Memory) 3. FIG. 21A illustrates one example of the data. An axis of ordinate represents a basis weight of a sheet, while an axis of abscissa represents a length of a sheet. The length of the sheet that needs the blowing air is within the range of 250 mm to 500 mm. The necessary rotation amount (mm) of the pressure motor 301 to the pressure force (gf) is illustrated within the basis weight of each sheet. The data is obtained from an experiment. However, the data may be obtained based on not only the basis weight of the sheet but also the surface property of the sheet.

Accordingly, even if the sheet is an ultrathin sheet, the double feed of the uppermost sheet and the following sheet can be prevented. Moreover, the defective feed such as skew feeding, corner bending, or absorption failure, can be reduced.

In the present exemplary embodiment, the pressure motor 301 is used as the moving mechanism, but an actuator such as a solenoid may be used as the moving mechanism. In the present exemplary embodiment, the pressure roller 302 is used as the pressure member. However, a lever in which the contact portion of the top surface of the sheet is made of a material having a low friction coefficient that does not become the conveyance resistance to the sheet may be used.

A fifth exemplary embodiment of the present invention will next be described. The present exemplary embodiment has a configuration for stabilizing the conveyance property when the sheet is absorbed and conveyed by the absorption conveyance portion 151 of the sheet feeding apparatus provided with the pressure portion 300 in FIG. 14. When the top surface of the uppermost sheet Sa is pressed by the pressure portion 300, downward force is applied on the sheet Sa by the pressure roller 302. Therefore, when the sheet Sa is absorbed and conveyed by the absorption conveyance portion 151 with the sheet receiving the pressure force from the pressure portion 300, the pressure force becomes the conveyance load of the sheet, which might prevent the sheet from having a stable conveyance property. In view of this, in the present exemplary embodiment, the pressure force from the pressure portion 300 is adjusted to be capable of performing a stable absorption conveyance of the sheet.

Specifically, the pressure portion 300 can apply pressure on the top surface of the sheet with a first pressure force controlled to apply pressure on the top surface of the uppermost sheet with a predetermined pressure force and a second pressure force controlled to apply pressure on the sheet with a pressure force smaller than the first pressure force. After receiving the sheet feed start signal, the CPU 1 starts the control in which the sheet is pressed with the first pressure force by the pressure portion 300. The CPU 1 also changes the pressure force from the pressure portion 300 from the first pressure force to the second pressure force during the period from the start of the absorption of the sheet by the absorption conveyance portion 151 to the start of the conveyance of the sheet by the absorption conveyance portion 151. The pressure force applied on the top surface of the uppermost sheet by the second pressure force is set to be small to a degree in which pressure force does not become the conveyance load to the sheet.

Figure 15:
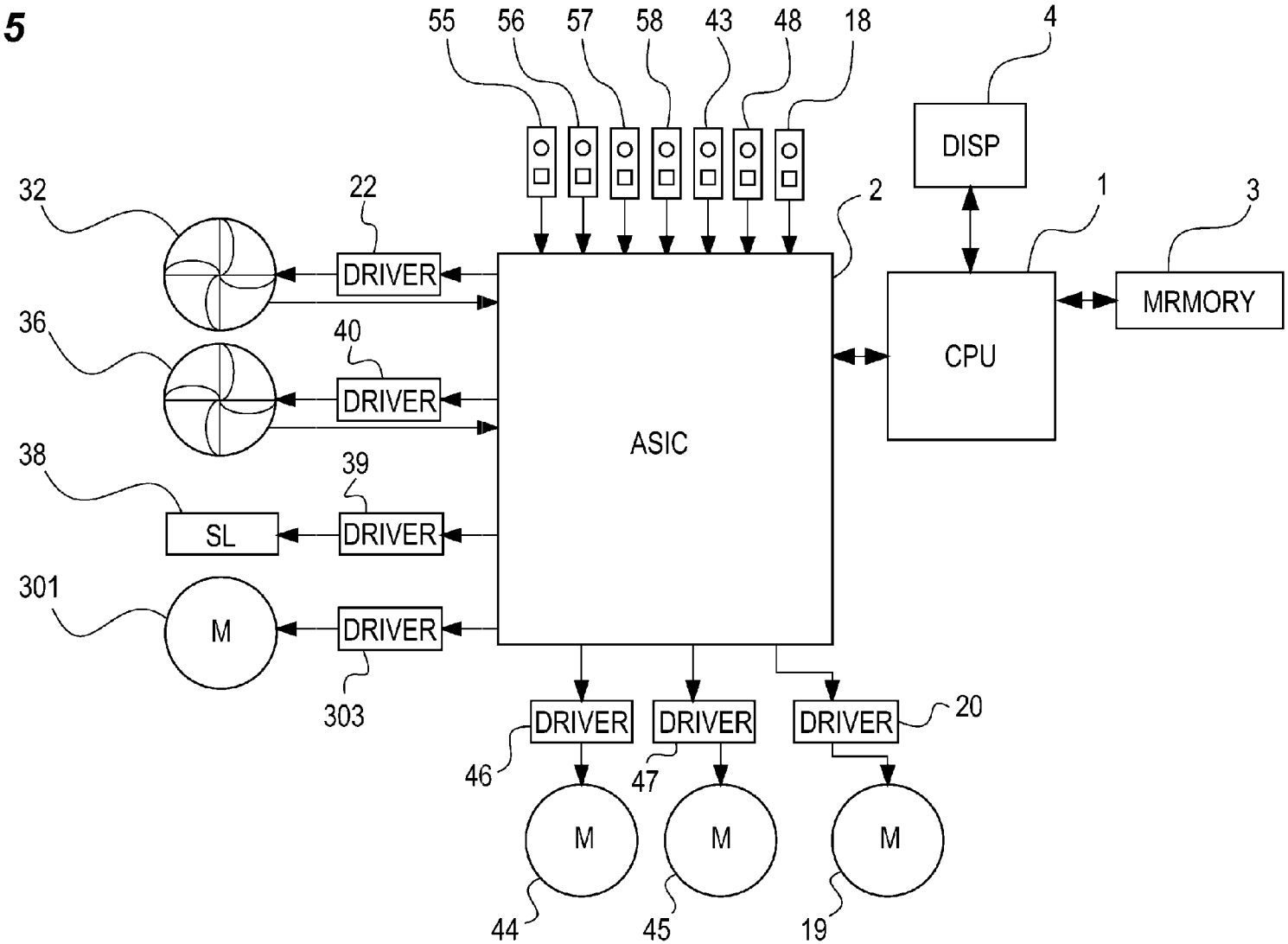
FIG. 15 is a control block diagram for controlling the sheet feeding apparatus according to the fourth exemplary embodiment.

FIG. 15 is a view for describing a configuration of a circuit control block of the sheet feeding apparatus according to the fourth exemplary embodiment. In the circuit block diagram, the pressure motor 301 and the drive circuit 303 are connected to the ASIC 2, instead of the blowing fan drive circuit 29 and the blowing fan 30, with respect to the circuit block diagram illustrated in FIG. 4 described in the first exemplary embodiment. The pressure motor 301 moves the pressure roller 302 in order that the pressure roller 302 is in contact with the top surface of the uppermost sheet, and the drive circuit 303 is provided for controlling drive of the pressure motor 301. The other portions are the same as those in the circuit block diagram in FIG. 4, so that the description will not be repeated.

Figure 16:
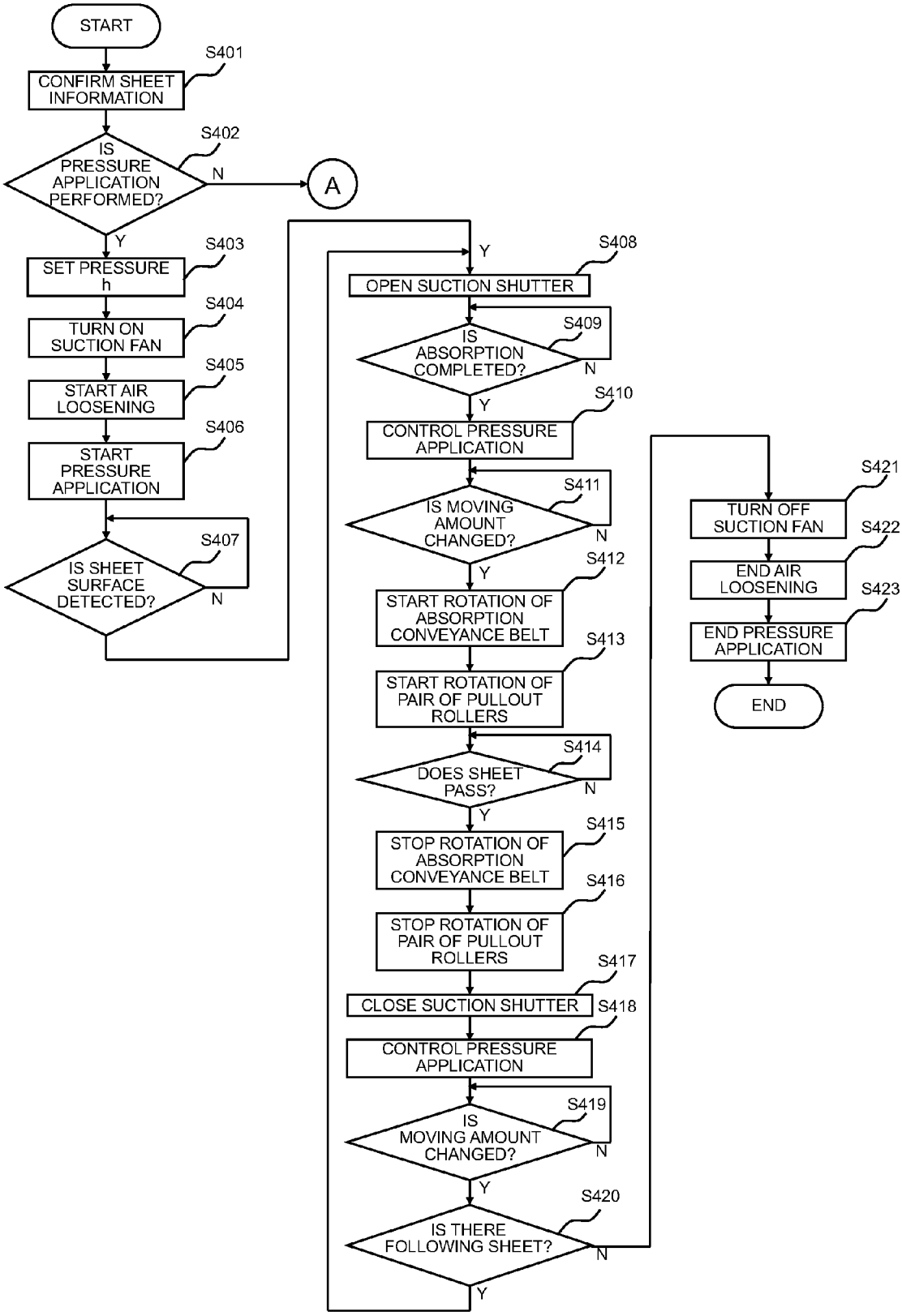
FIG. 16 is a first flowchart for describing a sheet feeding operation of a sheet feeding apparatus according to a fifth exemplary embodiment of the present invention.
Figure 17:
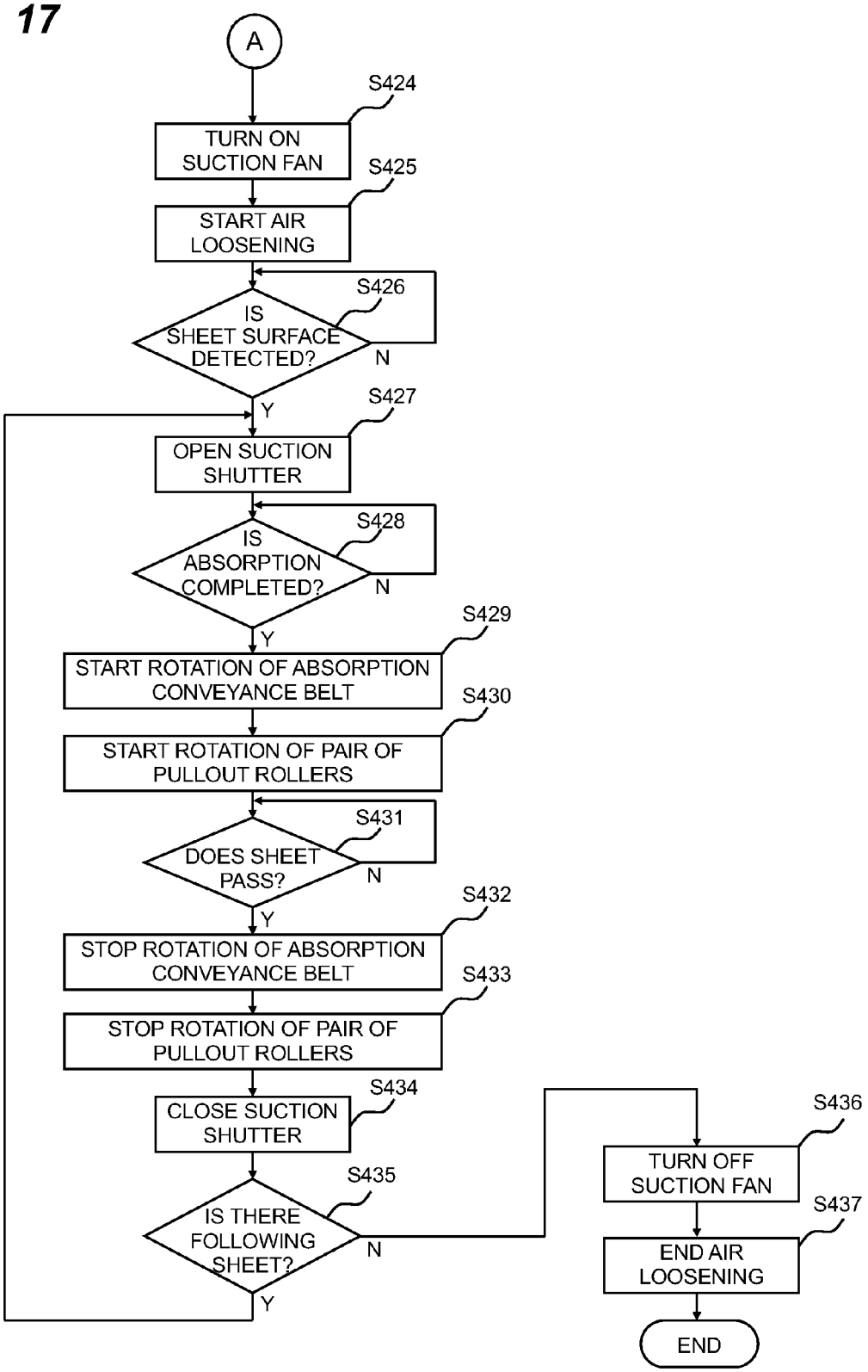
FIG. 17 is a second flowchart for describing the sheet feeding operation of the sheet feeding apparatus according to the fifth exemplary embodiment.

FIGS. 16 and 17 are flowcharts for describing the control of the circuit block controlling the sheet feeding apparatus in the fifth exemplary embodiment. The operation of the sheet feeding apparatus according to the fifth exemplary embodiment will be described with reference to the flowcharts. The basic operation for feeding a sheet is the same as that in the first exemplary embodiment.

Like the first exemplary embodiment, the tray 12 is lifted by the lifter motor 19, and then, the tray 12 stops at the position (illustrated in FIG. 2) where the distance between the uppermost sheet Sa and the absorption conveyance belt 21 becomes B.

After receiving the sheet feeding signal, the CPU 1 confirms the sheet information input by the operation portion 4 (S401). Then, the CPU 1 determines whether the sheet needs the application of pressure based on the confirmed sheet information and the storage unit 3 storing the sheet information (S402). The sheet information is based on the length of the sheet, the basis weight, or the surface property. When the CPU 1 determines that the sheet needs the application of pressure (Y in step S402), the CPU 1 sets a pressure force according to the sheet information (S403). The pressure force is obtained from data. The data is the same as in the fourth exemplary embodiment, and the rotation amount of the pressure motor 301 corresponding to the pressure force set based on the data is obtained.

After setting the pressure force, the CPU 1 inputs the control signal to the suction fan drive circuit 40 to drive (ON) the suction fan 36 (S404). Additionally, the CPU 1 inputs the control signal to the loosening fan drive circuit to drive (ON) the loosening fan 32, thereby starting the air loosening (S405). The CPU 1 also inputs the control signal to the pressure roller drive circuit 303 to drive the pressure roller 302 by the pressure motor 301 in the pressure portion 300, thereby starting the application of pressure on the top surface of the uppermost sheet Sa (S406). The pressure force of the pressure portion 300 in this case is the pressure force based on the data in FIG. 21A in the fourth exemplary embodiment, and the pressure force is the first pressure force that can suppress the rise of the sheet.

Thereafter, the surface of the uppermost sheet Sa is located on the position where the distance between the uppermost sheet Sa and the absorption conveyance belt 21 becomes B' by the air loosening, and then, the CPU 1 waits for the sheet surface detected by the sheet surface detection sensor 18 (S407). When the sheet surface detection sensor 18 detects the surface of the uppermost sheet Sa, the CPU 1 inputs the control signal to the suction solenoid drive circuit 39 to drive the suction solenoid 38, thereby opening the suction shutter 37 in the suction duct 34 by rotating the same in the direction of G in FIG. 12. The absorption force in the direction of H in FIG. 12 is generated by the opening of the suction shutter 37, whereby the uppermost sheet 35*a* is absorbed (S408).

Figure 21B:
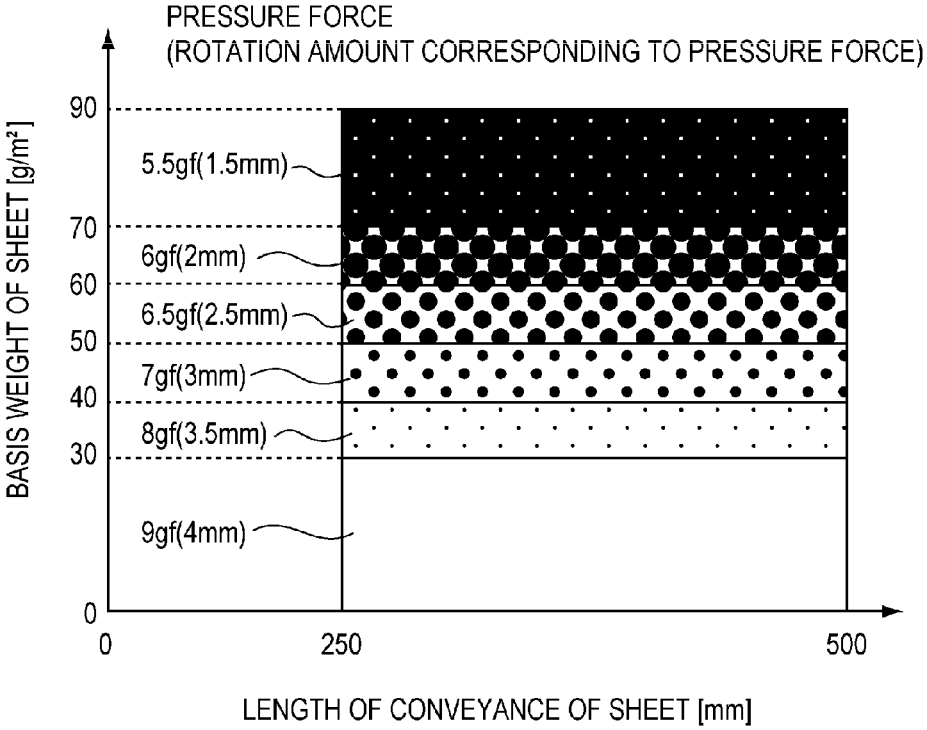
Figure 22:
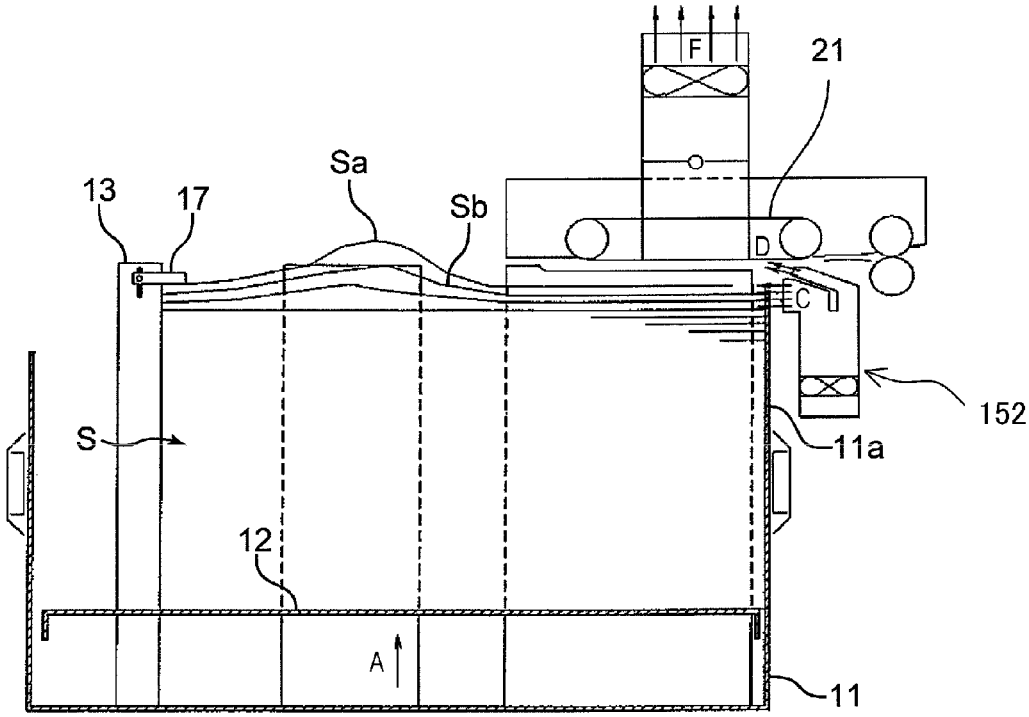
FIG. 22 PRIOR ART
FIG. 22 is a view for describing an issue in a conventional sheet feeding apparatus.

Then, the CPU 1 monitors the output from the absorption completion sensor 58 until the absorption of the uppermost sheet 35*a* is completed. When the CPU 1 detects the completion of the absorption (Y in step S409), the CPU 1 proceeds to the following process. After the completion of the absorption, the CPU 1 controls the pressure motor 301 in such a manner that the pressure force by the pressure roller 302 becomes a predetermined value (S410). The pressure force by the pressure roller 302 is set based on the table illustrated in FIG. 21B, for example, and is controlled to be a predetermined pressure force or less depending on the rotation amount of the pressure motor 301 (S411). The pressure force of the pressure portion 300 is the second pressure force smaller than the first pressure force. The second pressure force applied on the top surface of the uppermost sheet is set to be small to a degree in which the second pressure force does not become the conveyance load to the sheet. When the pressure force by the pressure roller 302 becomes the predetermined pressure or less (Y in step S411), the CPU 1 inputs the control signal to the feeding motor drive circuit 46 to drive the feeding motor 44, thereby rotating the absorption conveyance belt 21 in the direction of J in FIG. 12 (S412). The CPU 1 also inputs the control signal to the pullout motor drive circuit 47 to drive the pullout motor 45, thereby starting the rotation of the pair of pullout rollers 42 in the directions of P and M in FIG. 12 (S413). With this process, the sheet is discharged onto the sheet conveyance path.

When the pressure force by the pressure roller 302 does not become the predetermined pressure or less (N in step S411), the CPU 1 waits until the pressure force becomes the predetermined pressure force. Thereafter, the CPU 1 monitors whether the sheet discharged onto the sheet conveyance path passes through the passage sensor 43. When the CPU 1 confirms the passage of the sheet, the CPU 1 stops the rotation of the absorption conveyance belt 21 (S415), and stops the rotation of the pair of pullout rollers 42 (S416). The CPU 1 also closes the suction shutter 37 in the suction duct 34 (S417). The CPU 1 then controls the rotation amount of the pressure motor 301 in order that the pressure force by the pressure roller 302 again becomes the initial pressure force, thereby controlling such that the pressure force becomes the predetermined pressure force or more (S418). When the pressure force by the pressure roller 302 becomes the predetermined pressure or more (Y in step S419), the CPU 1 further proceeds. When there are plural sheets to be fed, and the following sheet is to be fed, the CPU 1 returns to step S408 to perform the similar process (Y in step S420).

When there is no following sheet, and the feeding operation is ended (N in step S420), the CPU 1 inputs the control signal to the suction fan drive circuit 40 to stop the suction fan 36 (S411). Similarly, the CPU 1 inputs the control signal to the loosening fan drive circuit to stop the loosening fan 32 (S422), and inputs the control signal to the pressure roller drive circuit, thereby releasing the pressure of the pressure roller 302 to move the pressure portion 300 to a retracting position. Then, the CPU 1 stops the pressure portion 300 (S423) to end the operation. When the CPU 1 determines that the pressure application by the pressure portion 300 is unnecessary (N in step S402), the CPU 1 proceeds to step S424. The processes from steps S424 to S437 are those in which the pressure applying process by the pressure portion 300 is not executed, so that the description will not be repeated.

The control (S410) of the pressure roller 302 is performed after the completion of the absorption (S409). However, the control of the pressure roller 302 may be performed during the period from the opening of the suction shutter 37 (S408) to the operation of the absorption conveyance belt 21 (S412).

In step S418, the pressure force of the pressure roller 302 is controlled again to be the initial pressure force. However, the control of the pressure roller 302 may be started depending on the distance conveyed by the absorption conveyance belt and time in step S412.

The flowcharts of control in the fourth exemplary embodiment are the same as those in FIGS. 16 and 17 in the fifth exemplary embodiment from which steps S410, S411, S418, and S419 are skipped.

In the fifth exemplary embodiment, the pressure portion 300 applies pressure on the top surface of the sheet at the timing when the loosening air is blown to the sheet. Therefore, there is a possibility that the pressure be applied with the sheet being slightly shifted by the blown loosening air. In view of this, the loosening air is blown to the sheet after the pressure application by the pressure portion 300 is stabilized, whereby a more stable sheet feeding operation can be performed.

Figure 18:
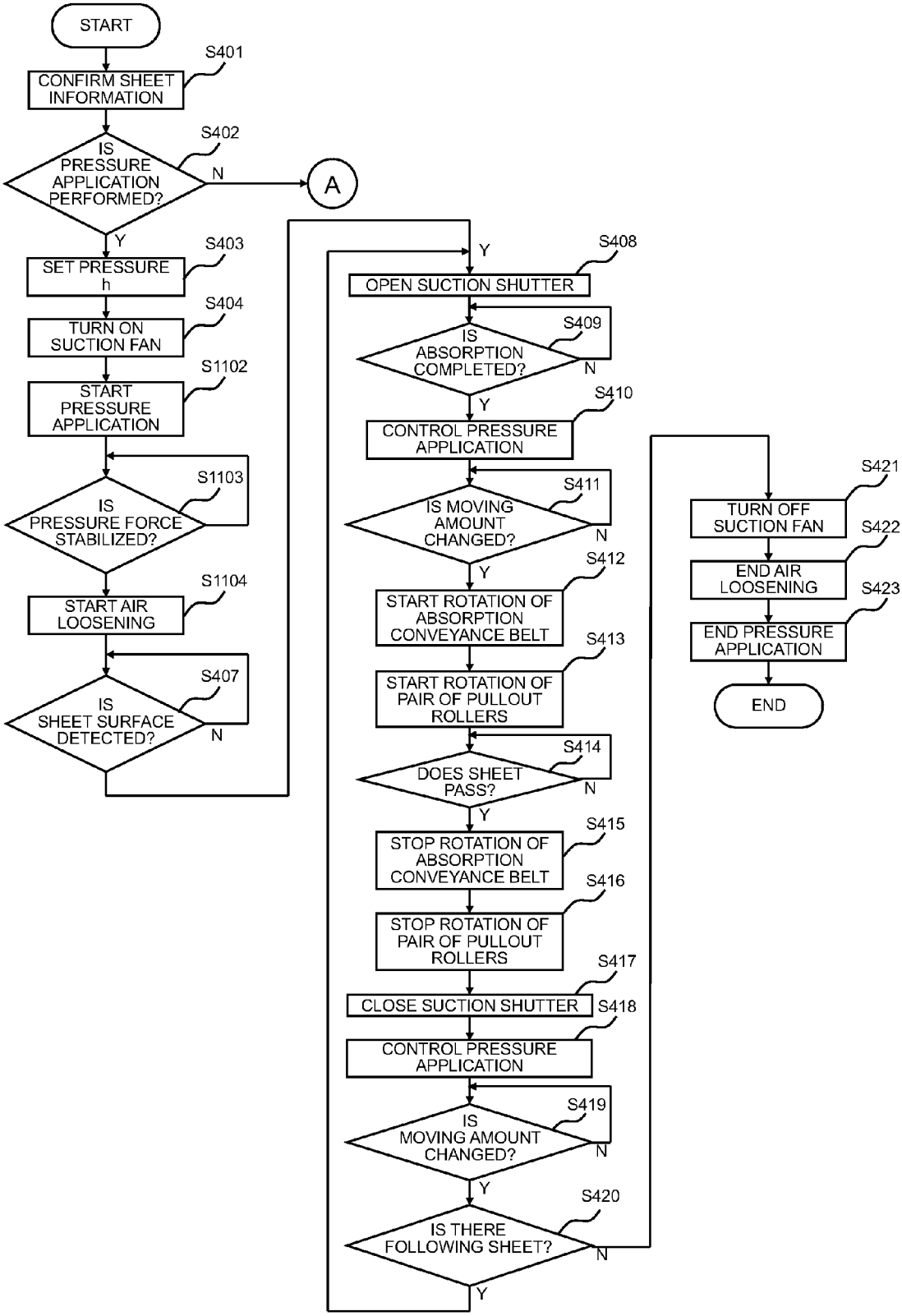
FIG. 18 is a flowchart illustrating an example of a modification of the fifth exemplary embodiment.

This operation will be described with reference to the flowchart in FIG. 18. In the flowchart of FIG. 18, the processes between the process of "turn ON suction fan" (S404) and the process of "start air loosening" (S405) are different from the flowcharts in FIGS. 16 and 17, so that the different portions will be described. The other processes are the same as those in the flowcharts in FIGS. 16 and 17, so that the description will not be repeated.

After receiving the sheet feeding signal, the CPU 1 inputs the control signal to the suction fan drive circuit 40 to drive the suction fan 36 (S1101). Similarly, the CPU 1 inputs the control signal to the pressure roller drive circuit to drive the pressure portion 300, thereby allowing the pressure roller 302 to be in contact with the top surface of the sheet so as to apply pressure (S1102). The CPU 1 waits until the pressure force to the top surface of the sheet is stabilized (S1103), and then, inputs the control signal to the loosening fan drive circuit to drive the loosening fan 32, thereby starting the air loosening (S1104). Since the pressure is applied on the sheet by the pressure portion 300 at the point of starting the air loosening, the rise of the sheet, which is caused because the sheet is pushed toward the trailing end of the sheet by the loosening air, can be prevented.

In the respective exemplary embodiments, the sheet feeding apparatus controls various loads of the sheet feeding apparatus, such as a motor or a fan, by the CPU 1 via the exclusive ASIC 2. However, the CPU 1 may directly control these loads. As the sheet information, not the sheet information input from the operation portion 4 serving as an input unit, but sheet information automatically recognized in the sheet feeding apparatus may be used.

In the above description, the present invention is applied to the sheet feeding apparatus that feeds a sheet to an image forming portion. However, the present invention is not limited thereto. For example, in an image forming apparatus including an image forming apparatus body, a sheet processing apparatus, and an inserter, the present invention may be applied to a sheet feeding apparatus provided to the inserter or the sheet processing apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-113291, filed May 17, 2010, which is hereby incorporated by reference herein in its entirety.

What is claimed is:

1. A sheet feeding apparatus comprising:

a tray that supports sheets and that can be lifted and lowered;

an air blowing portion configured to blow air toward the upstream in a sheet feeding direction from a downstream end of the sheets supported on the tray in the sheet feeding direction to blow the sheets upward;

an absorption conveyance portion configured to absorb and convey an uppermost sheet which is blown upward by the air blown by the air blowing portion;

a trailing end restricting portion configured to restrict the position of trailing ends of the sheet in the sheet feeding direction; and an upper air blowing portion provided above the tray between the trailing end restricting portion and the absorption conveyance portion and configured to apply pressure downward on the top surface of the uppermost sheet of the sheets supported on the tray by blowing air to the top surface of the uppermost sheet from above to restrict the movement of the sheets supported on the tray in the direction reverse to the sheet feeding direction with the air blown by the air blowing portion; and a controlling portion configured to control the operation of the upper air blowing portion.

2. The sheet feeding apparatus according to claim 1, further comprising an input portion configured to input sheet information including at least one of sheet-size information, basis-weight information, and surface-property information, wherein the controlling portion drives the upper air blowing portion to blow air to the top surface of the uppermost sheet, when it determines, based on the sheet information input from the input portion, that the sheets on the tray are the sheets that move in the direction reverse to the sheet feeding direction due to the air blown from the air blowing portion.

3. The sheet feeding apparatus according to claim 1, further comprising an input unit configured to input sheet information including at least one of sheet-size information, basis-weight information, and surface-property information, wherein the controlling portion controls the air blowing amount of the air blowing portion, based on the sheet information, such that the wind pressure, applied on the sheet, of the air blown by the upper air blowing portion becomes equal to the wind pressure, applied on the sheet, of the air blown by the air blowing portion.

4. The sheet feeding apparatus according to claim 1, wherein the upper air blowing portion and the absorption conveyance portion communicate with each other, and the upper air blowing portion uses the suction air of the absorption conveyance portion as the blowing air.

5. The sheet feeding apparatus according to claim 1, wherein the controlling portion controls the upper air blowing portion and the air blowing portion such that, toward the top surface of the uppermost sheet of the sheets supported on the tray, the air blowing portion blows air from the downstream end of the sheets, supported on the tray, in the sheet feeding direction after the start of the air blowing by the upper air blowing portion.

6. The sheet feeding apparatus according to claim 1, wherein the upper air blowing portion can blow air with a first wind pressure controlled to apply pressure on the top surface of the uppermost sheet with a predetermined pressure force, and with a second wind pressure controlled to apply pressure on the sheet with a pressure force lower than the pressure force by the first wind pressure, and the controlling portion starts to control the upper air blowing portion to blow air with the first wind pressure after receiving a sheet feeding start signal, and controls the upper air blowing portion to change the air with the first wind pressure to the air with the second wind pressure during the period from the start of the absorption of the sheet by the absorption conveyance portion to the start of the conveyance of the sheet by the absorption conveyance portion.

7. A sheet feeding apparatus comprising:

a tray that supports sheets and that can be lifted and lowered;

an air blowing portion configured to blow air toward the upstream in a sheet feeding direction from a downstream end of the sheets supported on the tray in the sheet feeding direction to blow the sheet upward;

an absorption conveyance portion configured to absorb and convey an uppermost sheet which is blown upward by the air blown by the air blowing portion;

a trailing end restricting portion configured to restrict the position of trailing ends of the sheets in the sheet feeding direction;

a pressure portion provided above the portion of the tray between the trailing end restricting portion and the absorption conveyance portion and configured to apply pressure downward on the top surface of the uppermost sheet of the sheets supported on the tray to restrict the movement of the sheets supported on the tray in the direction reverse to the sheet feeding direction;

an input portion configured to input sheet information including at least one of sheet-size information, basis-weight information, and surface-property information; and a controlling portion configured to control the pressure portion so as to apply pressure on the top surface of the uppermost sheet by the pressure portion, when it determines, based on the sheet information input from the input unit, that the sheets on the tray are the sheets that move in the direction reverse to the sheet feeding direction due to the air blown from the air blowing portion.

8. The sheet feeding apparatus according to claim 7, wherein the pressure portion can apply pressure on the sheet with a first pressure force for applying pressure on the top surface of the uppermost sheet, and with a second pressure force, lower than the first pressure force, for applying pressure on the sheet, and the controlling portion starts the application of pressure with the first pressure force by the pressure portion after receiving a sheet feeding start signal, and controls the pressure portion to change the pressure force from the first pressure force to the second pressure force during the period from the start of the absorption of the sheet by the absorption conveyance portion to the start of the conveyance of the sheet by the absorption conveyance portion.

9. A sheet feeding apparatus comprising:

a tray that supports sheets and that can be lifted and lowered;

an air blowing portion configured to blow air toward the upstream in a sheet feeding direction from a downstream end of the sheets supported on the tray in the sheet feeding direction to blow the sheets upward;

an absorption conveyance portion configured to absorb and convey an uppermost sheet which is blown upward by the air blown by the air blowing portion;

a trailing end restricting portion configured to restrict the position of trailing ends of the sheets in the sheet feeding direction;

a pressure portion provided above the portion of the tray between the trailing end restricting portion and the absorption conveyance portion and configured to apply pressure downward on the top surface of the uppermost sheet of the sheets supported on the tray to restrict the movement of the sheets supported on the tray in the direction reverse to the sheet feeding direction, wherein the pressure portion includes a pressure member that is in contact with the top surface of the uppermost sheet of the sheets supported on the tray for applying pressure, and a moving mechanism configured to move the pressure member between a position where the pressure member is in contact with the top surface of the uppermost sheet to apply pressure thereon and a position where the pressure member is separated from the top surface of the uppermost sheet; and a controlling portion configured to control the pressure portion and the air blowing portion such that the air blowing portion blows air from the downstream end of the sheets supported on the tray after the start of applying pressure on the top surface of the uppermost sheet by the pressure member of the pressure portion.

10. An image forming apparatus configured to form an image at an image forming portion onto a sheet fed by a sheet feeding apparatus, the sheet feeding apparatus comprising:

a tray that supports sheets and that can be lifted and lowered;

an air blowing portion configured to blow air toward the upstream in a sheet feeding direction from a downstream end of the sheets supported on the tray in the sheet feeding direction to blow the sheets upward;

an absorption conveyance portion configured to absorb and convey an uppermost sheet, which is blown upward by the air blown by the air blowing portion;

a trailing end restricting portion configured to restrict the position of trailing ends of the sheets in the sheet feeding direction;

an upper air blowing portion provided above the tray between the trailing end restricting portion and the absorption conveyance portion and configured to apply pressure downward on the top surface of the uppermost sheet of the sheets supported on the tray by blowing air to the top surface of the uppermost sheet from above to restrict the movement of the sheets supported on the tray in the direction reverse to the sheet feeding direction with the air blown by the air blowing portion; and a controlling portion configured to control the operation of the upper air blowing portion.

11. The image forming apparatus according to claim 10, further comprising an input portion configured to input sheet information including at least one of sheet-size information, basis-weight information, and surface-property information, wherein the controlling portion drives the upper air blowing portion to blow air to the top surface of the uppermost sheet, when it determines, based on the sheet information input from the input portion, that the sheets on the tray are the sheets that move in the direction reverse to the sheet feeding direction due to the air blown from the air blowing portion.

12. The image forming apparatus according to claim 10, further comprising an input portion configured to input sheet information including at least one of sheet-size information, basis-weight information, and surface-property information, wherein the controlling portion controls the air blowing amount of the air blowing portion, based on the sheet information, such that the wind pressure, applied on the sheet, of the air blown by the upper air blowing portion becomes equal to the wind pressure, applied on the sheet, of the air blown by the air blowing portion.

13. The image forming apparatus according to claim 10, wherein the upper air blowing portion and the absorption conveyance portion communicate with each other, and the upper air blowing portion uses the suction air of the absorption conveyance portion as the blowing air.

14. The image forming apparatus according to claim 10, wherein the controlling portion controls the upper air blowing portion and the air blowing portion such that, toward the top surface of the uppermost sheet of the sheets supported on the tray, the air blowing portion blows air from the downstream end of the sheets supported on the tray, in the sheet feeding direction after the start of the air blowing by the upper air blowing portion.

15. The image forming apparatus according to claim 10, wherein the upper air blowing portion can blow air with a first wind pressure controlled to apply pressure on the top surface of the uppermost sheet with a predetermined pressure force, and with a second wind pressure controlled to apply pressure on the sheet with a pressure force lower than the pressure force by the first wind pressure, and the controlling portion starts to control the upper air blowing portion to blow air with the first wind pressure after receiving a sheet feeding start signal, and controls the upper air blowing portion to change the air with the first wind pressure to the air with the second wind pressure during the period from the start of the absorption of the sheet by the absorption conveyance portion to the start of the conveyance of the sheet by the absorption conveyance portion.

16. An image forming apparatus, comprising:

a tray that supports sheets and that can be lifted and lowered;

an air blowing portion configured to blow air toward the upstream in a sheet feeding direction from a downstream end of the sheets supported on the tray in the sheet feeding direction to blow the sheets upward;

an absorption conveyance portion configured to absorb and convey an uppermost sheet which is blown upward by the air blown by the air blowing portion;

a trailing end restricting portion configured to restrict the position of trailing ends of the sheets in the sheet feeding direction;

a pressure portion provided above the portion of the tray between the trailing end restricting portion and the absorption conveyance portion and configured to apply pressure downward on the top surface of the uppermost sheet of the sheets supported on the tray to restrict the movement of the sheets supported on the tray in the direction reverse to the sheet feeding direction;

an input portion configured to input sheet information including at least one of sheet-size information, basis-weight information, and surface-property information; and a controlling portion configured to control the pressure portion so as to apply pressure on the top surface of the uppermost sheet by the pressure portion, when it determines, based on the sheet information input from the input portion, that the sheet on the tray is the sheet that moves in the direction reverse to the sheet feeding direction due to the air blown from the air blowing portion.

17. The image forming apparatus according to claim 16, wherein the pressure portion can apply pressure on the sheet with a first pressure force for applying pressure on the top surface of the uppermost sheet, and with a second pressure force, lower than the first pressure force, for applying pressure on the sheet, and the controlling portion starts the application of pressure with the first pressure force by the pressure portion after receiving a sheet feeding start signal, and controls the pressure portion to change the pressure force from the first pressure force to the second pressure force during the period from the start of the absorption of the sheet by the absorption conveyance portion to the start of the conveyance of the sheet by the absorption conveyance portion.

18. An image forming apparatus, comprising:

a tray that supports sheets and that can be lifted and lowered;

an air blowing portion configured to blow air toward the upstream in a sheet feeding direction from a downstream end of the sheets supported on the tray in the sheet feeding direction to blow the sheets upward;

an absorption conveyance portion configured to absorb and convey an uppermost sheet which is blown upward by the air blown by the air blowing portion;

a trailing end restricting portion configured to restrict the position of trailing ends of the sheets in the sheet feeding direction;

a pressure portion provided above the portion of the tray between the trailing end restricting portion and the absorption conveyance portion and configured to apply pressure downward on the top surface of the uppermost sheet of the sheets supported on the tray to restrict the movement of the sheet supported on the tray in the direction reverse to the sheet feeding direction, wherein the pressure portion includes a pressure member that is in contact with the top surface of the uppermost sheet of the sheets supported on the tray for applying pressure, and a moving mechanism configured to move the pressure member between a position where the pressure member is in contact with the top surface of the uppermost sheet to apply pressure thereon and a position where the pressure member is separated from the top surface of the uppermost sheet; and a controlling portion configured to control the moving mechanism and the air blowing portion such that the air blowing portion blows air from the downstream end of the sheets supported on the tray after the start of applying pressure on the top surface of the uppermost sheet by the pressure member of the pressure portion.

* * * * *